US005139150A

United States Patent [19]

Fuller, Jr. et al.

[11] Patent Number: 5,139,150

[45] Date of Patent: Aug. 18, 1992

[54] ARTICLE SORTING APPARATUS AND METHOD

[75] Inventors: Robert L. Fuller, Jr., Issaquah; Paul E. Faville, Renton, both of Wash.

[73] Assignee: The Boeing Company, Seattle, Wash.

[21] Appl. No.: 270,221

[22] Filed: Nov. 10, 1988

[51] Int. Cl.[5] ..... B07C 5/00; B07C 5/36

[52] U.S. Cl. ..... 209/576; 198/778; 198/345.1; 198/463.4; 198/532; 209/586; 209/598; 209/698; 209/911; 209/912; 209/914

[58] Field of Search ..... 209/558, 576, 589, 587, 209/698, 912, 911, 916, 939, 707, 934, 598, 557, 914, 933, 551, 586, ; 198/778, 345, 463.4, 532

[56] References Cited

U.S. PATENT DOCUMENTS

| | | | |
|---|---|---|---|
| 719,751 | 2/1903 | Condon | 104/25 |
| 1,090,948 | 3/1914 | Sklovsky et al. | 104/91 |
| 1,367,199 | 2/1921 | Miller | 209/605 |
| 1,846,327 | 2/1932 | Gray | 209/626 |
| 1,957,231 | 5/1934 | Criner et al. | 198/463.4 |
| 2,186,652 | 1/1940 | Orth et al. | 209/642 |
| 2,453,977 | 11/1948 | Eames | 198/345 X |
| 2,464,449 | 3/1949 | Johnston | 209/625 |
| 2,794,551 | 6/1957 | Colling et al. | 209/676 |
| 2,873,854 | 2/1959 | Dapp et al. | 209/550 |
| 2,895,064 | 7/1959 | Hoff et al. | 310/29 |
| 2,982,405 | 5/1961 | Fitz Gerald | 209/626 |
| 2,982,406 | 5/1961 | Fitz Gerald | 209/626 |
| 2,984,350 | 5/1961 | Fitz Gerald | 209/626 |
| 2,997,158 | 8/1961 | Moskowitz et al. | 198/220 |
| 3,052,999 | 9/1962 | Sedgwick et al. | 40/2.2 |
| 3,178,008 | 4/1965 | Solet | 198/778 X |
| 3,197,027 | 7/1965 | Sargrove | 209/538 |
| 3,225,898 | 12/1965 | Roinestad | 198/181 |
| 3,225,902 | 12/1965 | Roinestad | 198/202 |
| 3,231,941 | 2/1966 | Flynn, Jr. | 19/106 |
| 3,261,451 | 7/1966 | Roinestad | 198/193 |
| 3,276,570 | 10/1966 | Hale et al. | 198/193 |
| 3,308,856 | 3/1967 | Ploss | 140/71 |
| 3,333,678 | 8/1967 | Rodman | 198/181 |
| 3,348,659 | 10/1967 | Roinestad | 198/136 |
| 3,366,248 | 1/1968 | Sedgwick et al. | 211/1.5 |
| 3,439,795 | 4/1969 | Roinestad et al. | 198/193 |
| 3,467,239 | 9/1969 | Roinestad | 198/195 |
| 3,528,136 | 9/1970 | Bechtel, Jr. et al. | 19/102 |
| 3,682,295 | 8/1972 | Roinestad | 198/203 |
| 3,716,128 | 2/1973 | Edge et al. | 198/38 |
| 3,727,690 | 7/1973 | Roinestad et al. | 198/193 |
| 3,737,953 | 6/1973 | Bechtel, Jr. | 19/113 |
| 3,793,677 | 2/1974 | Bechtel, Jr. | 19/113 |
| 3,794,155 | 2/1974 | Bechtel, Jr. | 198/194 |
| 3,812,965 | 5/1974 | Kurata et al. | 209/518 |
| 3,920,117 | 11/1975 | Roinestad | 198/194 |
| 4,074,392 | 2/1978 | Bechtel, Jr. | 19/113 |
| 4,078,655 | 3/1978 | Roinestad | 198/848 |
| 4,106,628 | 8/1978 | Warkentin et al. | 209/556 |
| 4,146,135 | 3/1979 | Sarkar | 209/565 X |
| 4,171,051 | 10/1979 | Wullenwaber | 209/542 |
| 4,194,634 | 3/1980 | Kelly | 209/576 X |
| 4,228,901 | 10/1980 | Watzka et al. | 198/463.4 X |
| 4,249,661 | 2/1981 | Lem | 209/564 |
| 4,260,506 | 9/1981 | Roinestad | D12/60 |
| 4,324,335 | 4/1982 | Conway et al. | 209/587 X |
| 4,383,604 | 5/1983 | Grandemange | 198/775 |
| 4,394,901 | 7/1983 | Roinestad | 198/850 |
| 4,398,318 | 8/1983 | Ashworth, III | 19/114 |
| 4,561,546 | 12/1985 | Maroney | 209/551 X |
| 4,685,557 | 8/1987 | Roinestad | 198/834 |
| 4,688,678 | 8/1987 | Zue et al. | 209/933 X |
| 4,741,430 | 5/1988 | Roinestad | 198/778 |
| 4,869,813 | 9/1989 | Bailey et al. | 209/586 X |

FOREIGN PATENT DOCUMENTS

| | | | |
|---|---|---|---|
| 961803 | 1/1975 | Canada | 209/586 |

OTHER PUBLICATIONS

Ashworth Bros., Inc., "An Introduction to Small Radius Ominflex and Small Radius Omni-Grid", Bulletin No. SR80, (Rev. 8/83).

*Primary Examiner*—Donald T. Hajec
*Attorney, Agent, or Firm*—Delbert J. Barnard

[57] ABSTRACT

A gravity conveyor (12) delivers drill bits (10) to carrier tubes (24) which are on an endless conveyor. An optical micrometer (22) or the like identifies the drill bits (10), as to shank type, maximum diameter, overall length, helix angle, back taper, number of margins, etc., and produces an identification signal which is directed to a control computer (B). An identified drill bit (10) is delivered into a given carrier tube (24). The computer (B) controls the endless conveyor (EC) to move the conveyor tube (24) into a position adjacent a dedicated receptacle (30) for the identified drill bit (10) which is one of a large number of dedicated receptacles (30) which are arranged in series alongside the path traversed by the endless conveyor (EC).

32 Claims, 18 Drawing Sheets

Fig. 9
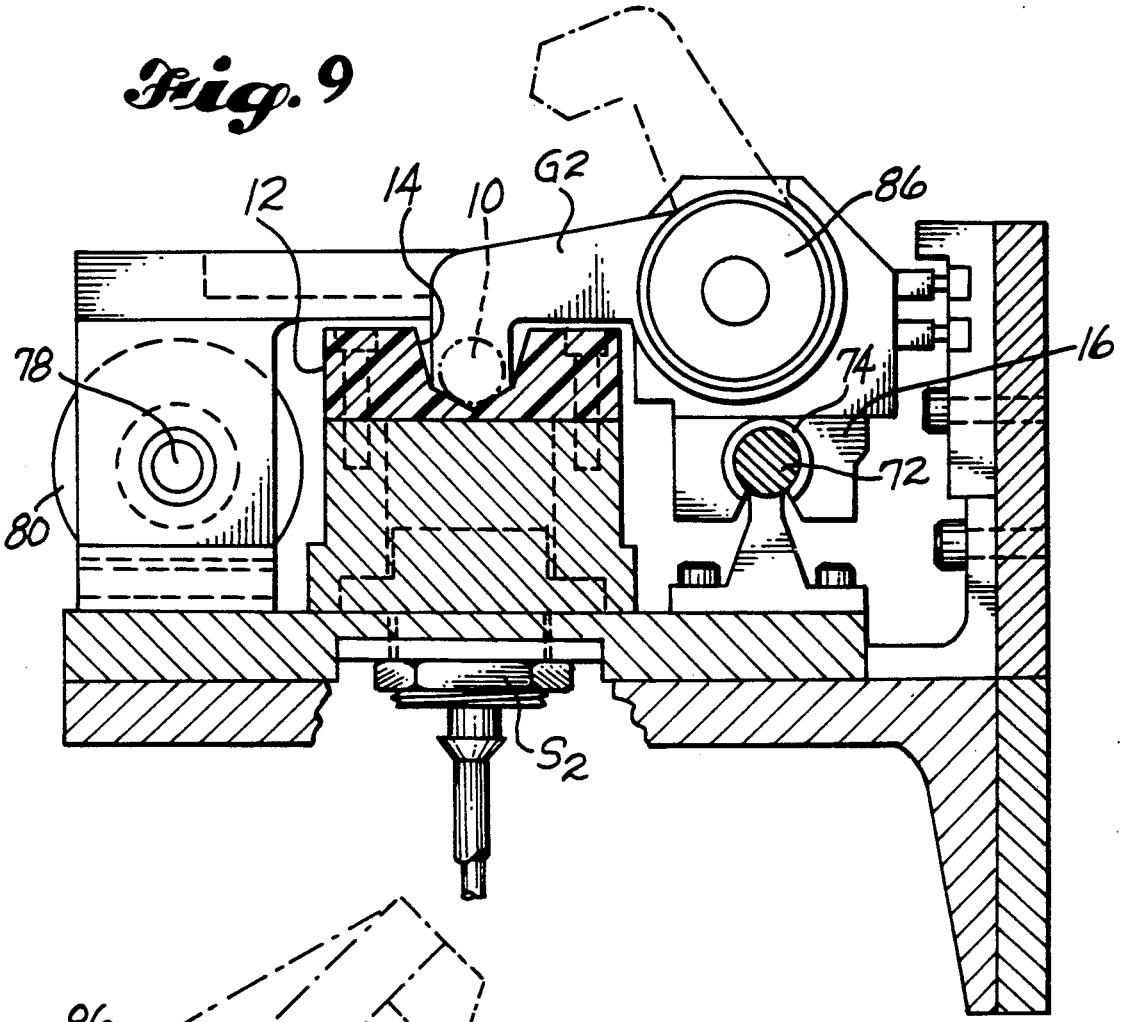
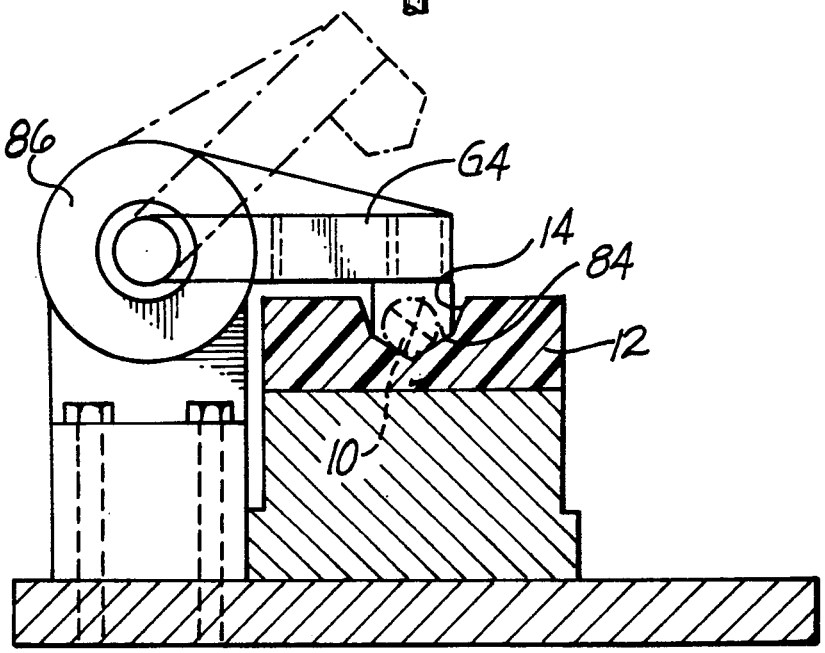
Fig. 10

ARTICLE SORTING APPARATUS AND METHOD

TECHNICAL FIELD

This invention relates to automated sorting of articles (e.g. drill bits). More particularly, it relates to a method and apparatus for automatically sorting a large number of many sizes or types of articles according to size or type.

BACKGROUND OF THE INVENTION

Many manufacturing operations (e.g. the manufacture of aircraft) require the drilling of a large number of holes in varying sizes. Drill bits are used until they become dull and then they are resharpened. In a typical aircraft manufacturing plant, it is necessary to resharpen an extremely large number of drill bits each week. By way of example, approximately fifty thousand used drill bits are resharpened each week by The Boeing Company in a facility in Auburn, Wash.

The used drill bits are cleaned and sorted before being resharpened. In the past, the sorting operation has been a manual process requiring a number of people (e.g. eight) to perform rough sorting and final sorting activities. In the manual process, cleaned drill bits are deposited onto a conveyor which moves them past two or three people who manually remove the drill bits from the conveyor and separate them into rough sort categories (e.g. 20–25 categories). The drill bits are then hand carried to final sort areas where additional personnel (e.g. five to six people) manually identify and place the drill bits into species bins. In the aforementioned Auburn facility of The Boeing Company, the drill bits to be sorted comprise over six hundred types or species. A principal object of the present invention is to provide a method and apparatus for sorting articles as to species, capable of being used to provide an automated drill bit sorting system which will replace the manual sorting operation presently in use.

RELATED APPLICATIONS

The method and apparatus of the present invention may be a part of an automated article sorting system which receives the articles in bulk, sometimes entangled, and automatically separates them and starts them on a path of travel in single file. By way of example, the articles can be separated and moved onto a conveyor, in single file, by use of a singulating system which forms the subject matter of a copending companion application Ser. No. 07/290,130, filed Nov. 10, 1988, and entitled "Article Singulating System and Method", now U.S. Pat. No. 4,933,074.

For some articles, the end-to-end orientation of the articles on the conveyor is important. By way of example, it is advantageous that drill bits to be sorted be moved through the sorting system with a common end (e.g. the shank end) leading. It saves wear and tear on hardware and simplifies the software. In such case, it is advantageous to correct the end-to-end orientation of the singulated articles which are not properly oriented when they are placed on the conveyor. Such orientation may be accomplished by use of an orientation system which forms the subject matter of a second copending companion application Ser. No. 07/270,251, filed Nov. 10, 1988, and entitled "Article Orientation System And Method", now U.S. Pat. No. 4,940,128.

It is desirable that the receiving bins or receptacles into which the sorted articles are placed be located close together in an area involving a relatively small amount of floor space. This can be accomplished by positioning the receiving bins side-by-side along a helical path. A receiving bin system of this type forms the subject matter of a third copending companion application Ser. No. 07/269,991, filed Nov. 10, 1988, and entitled "Storage Mechanism For Sorted Articles", now U.S. Pat. No. 4,924,998.

DISCLOSURE OF THE INVENTION

The article sorting system of the present invention is basically characterized by an endless conveyor which includes a series of article carriers which are connected together and movable in succession along an endless path, from and to an article loading station. The path borders a series of article receiving stations, each of which is associated with a particular species of article amongst the articles to be sorted. The endless conveyor is driven to move the article carriers along the path in steps, from each article receiving station to the next. The system includes a gravity conveyor for delivering articles to be sorted, one at a time, each to a separate article carrier while such article carrier is at the article loading station. An article identification means is positioned adjacent the gravity conveyor. It includes means for identifying the article as to species and generating an identification signal, as the article travels along the gravity conveyor past the article identification means to its article carrier. The system also includes means responsive to the identification signal and the movement of the article carrier and the article therein, from the article loading station into a position adjacent the associated receiving station, for moving the article out from its article carrier into the associated article receiving station.

In preferred form, the gravity conveyor includes a lead gate and an actuator for moving the lead gate between a stop position in which it is in the path of travel of an article on the gravity conveyor, and a retracted position in which it is retracted away from the path of travel an amount sufficient to allow the article to slide along the gravity conveyor, past the lead gate. A drive means is provided for moving the lead gate in position along the gravity conveyor at a controlled rate of travel. The drive means is positioned so that an article against the lead gate will move with the lead gate at a controlled rate of travel past the identification means. The system includes means for operating the actuator means to retract the lead gate following movement of the article past the article identification means, to enable the article to continue sliding along the gravity conveyor.

In preferred form, the means for moving the lead gate includes an elongated lead screw, a carriage including threads mating with the lead screw, and a motor for rotating the lead screw. Lead screw rotation in one direction causes the carrier to move downwardly along the lead screw and the gravity conveyor. Reverse rotation of the lead screw causes the carrier to move upwardly along the lead screw and the gravity conveyor. The lead gate and its actuator means are mounted on the carriage.

In preferred form, each article carrier includes a receptacle having an open article receiving end and releasable means for holding the receptacle in a position with its article receiving end directed upwardly by at least an amount sufficient to prevent the article from falling out of the receptacle. Each article carrier also includes pivot means connecting the receptacle to the endless conveyor and upon release of the releasable means permitting a tipping of the receptacle an amount sufficient to cause the article to move by gravity out from the receptacle. The means for moving the article out from the carrier may include a releasable means and an operator means for releasing the releasable means.

In preferred form, the endless conveyor includes guide means for guiding the receptacles to and past the article loading station. The guide means preferably includes a depressible portion which is in general alignment with the article loading station. The depressible portion initially positions each receptacle, as it arrives at the article loading station, into a position with its open article receiving end elevated above the gravity conveyor. A depress means is located at the article loading station. When a receptacle at the article loading station is ready to receive an article, the depress means is activated to push upon the receptacle and move it downwardly until its open article receiving end is in alignment with the gravity conveyor. The depressible portion of the guide means is movable downwardly in response to the downward movement of the receptacle. The guide means includes means for moving the depressible portion upwardly against the receptacle in response to a retraction of the depress means. This allows the depressible portion to move the receptacle upwardly until its open article receiving end is again above the gravity conveyor.

The article sorting system of the invention is especially adapted for sorting elongated articles according to species, such as, for example, a mixture of different sizes of drill bits. A perferred identification device for this type of article is an optical micrometer which includes means positioned to provide a scanner beam through which each article must pass as it travels along the gravity conveyor to its article conveyor, and means responsive to scanner beam interruption by the article for identifying the article as to species.

A second form of article identification means may be of a type which identifies the presence or absence of a particular material in the article. For example, in the sorting of drill bits, an x-ray fluorescence-type detector may be used for determining the presence or absence of a particular metal in a given drill bit. This type of identification means may be used in conjunction with an identification means which provides an identification signal based on the physical dimensions of the article. This will enable sorting of articles which are of the same physical dimension but differ as to the materials from which they are made. In a drill bit sorting operation, it permits the sorting of low speed and high speed drills which are of the same length and/or diameter, but differ in hardness due to a difference in their metallurgical make-up. By way of typical example, the particular material detector may be of the type disclosed in pending application Ser. No. 07/316,171, filed Feb. 24, 1989 and entitled "Material Composition Analyzer And Method".

Other objects, features and advantages of the invention are hereinafter set forth as a part of the description of the best mode of the invention.

BRIEF DESCRIPTION OF THE DRAWING

Like reference numerals or letters are used to designate like parts throughout the several views of the drawing, and:

FIG. 9 is a sectional view taken substantially along line 9—9 of FIG. 7, such view including a solid line showing of the lead gate in a down position and a broken line showing of the lead gate in a retracted position;

FIG. 10 is a sectional view taken substantially along line 10—10 of FIG. 8, such view including a solid line showing of the load gate in a down position and a broken line showing of the load gate in a retracted position;

BEST MODE FOR CARRYING OUT THE INVENTION

Figures 1, 1A:
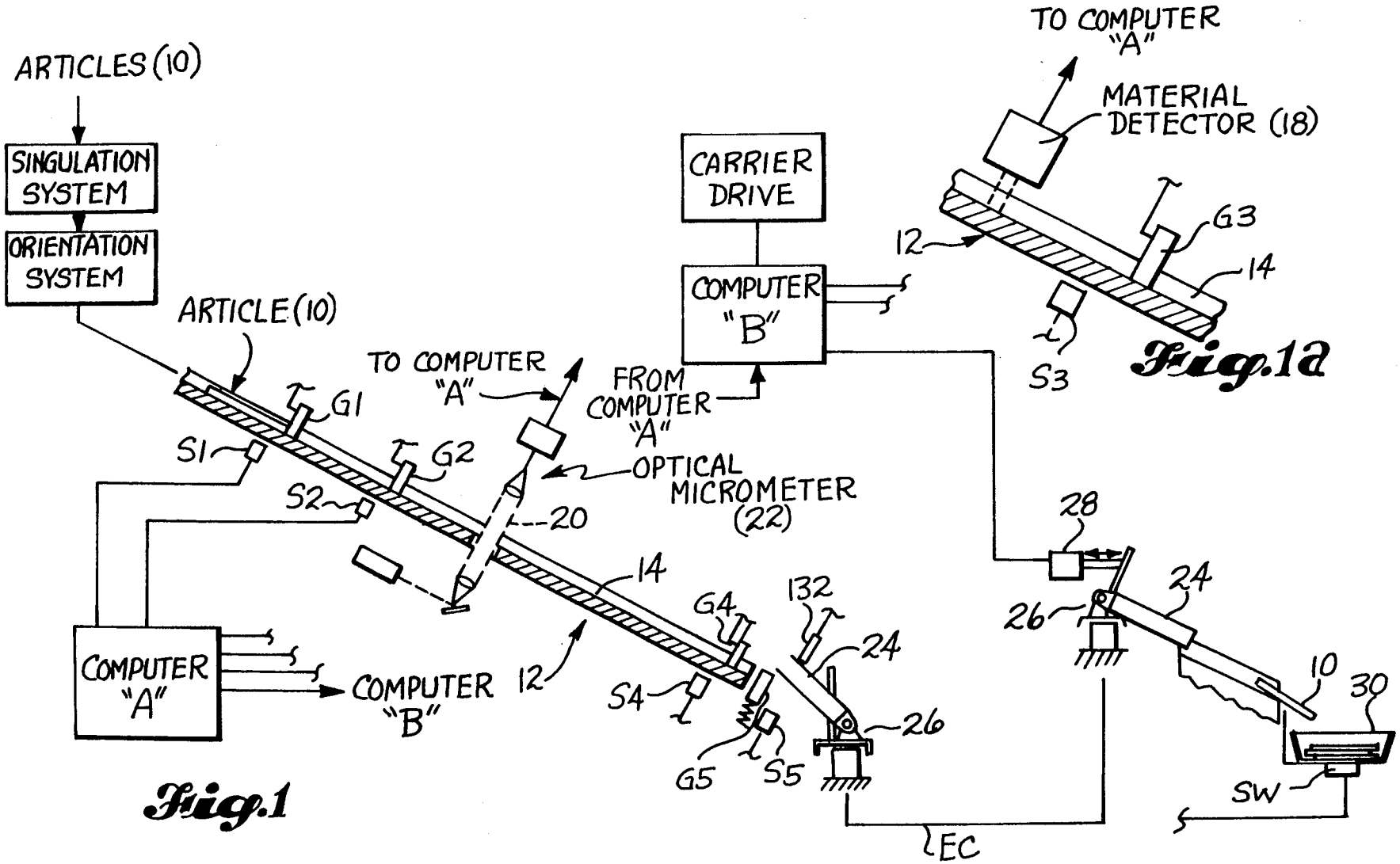
FIG. 1 is a schematic diagram of an article sorting system embodying the invention, with an article to be sorted positioned at a ready gate.
FIG. 1*a* is a fragmentary schematic diagram of an apparatus for detecting the presence or absence of a particular material in an article to produce an identification signal.

Referring to FIG. 1, articles 10 to be sorted may first require singulation and then orientation before being sorted. By way of typical example, the articles 10 to be sorted may be used drill bits which need to be resharpened. The drill bits after use are deposited into suitable collection containers (not shown). They become entangled together and must be separated and singulated in order to be handled, such as by use of the separating and singulating system which forms the subject matter of the aforementioned copending companion application entitled "Article Singulating System And Method".

The singulated drill bits may then be delivered to an orientation system which, if necessary, moves them end-for-end to position them shank end first, for delivery to the article sorting system of this invention. Such orientation may be accomplished by use of an orientation system which forms the subject matter of the aforementioned copending companion application entitled "Article Orientation System And Method". Of course, singulation and orientation, if required, may be performed by any suitable method and equipment. Some articles to be sorted may not require either singulation or orientation before being sorted, or may require one but not the other.

According to the invention, articles 10 to be sorted are delivered single file, proper end first (if end-to-end orientation makes a difference), onto the upper end of a gravity conveyor 12. The conveyor 12 includes a slideway which may be in the form of a channel 14 (FIG. 10) for guiding the articles 10 as they descend by gravity along the conveyor 12. The channel 14 may be in the form of a groove cut into a length of self-lubricating plastic material. This provides a lubricated slideway, to facilitate sliding movement of the articles 10 along the slideway.

Preferably, a first stop or gate G1 (hereinafter the "ready" gate) is provided near the upper end of the conveyor 12. As will hereinafter be described in more detail, ready gate G1 is movable vertically between a down or stop position and an up or retracted position. An article 10 moving onto the conveyor 12 free slides (i.e. slides under the force of gravity) down the slideway 14 until it contacts the ready gate G1. Ready gate G1 holds it in position until the system is ready to identify it. Then, the ready gate G1 is retracted to allow the article 10 to slide further downwardly until it contacts a second gate or stop G2 (hereinafter the "lead" gate). Lead gate G2 is also movable vertically between a down or stop position and an up or retracted position. In addition, it is mounted onto a carriage 16 which is operable for moving the gate G2 and an article 10 downwardly along the conveyor 12 at a controlled rate of travel.

Some articles 10 to be sorted may comprise plural species which are identical in terms of physical characteristics, e.g. length and diameter, but different in terms of chemical composition. For example, the articles to be sorted may include plural species of drill bits which have essentially the same physical characteristics but are constructed from different metals. FIG. 1*a* shows a material detector 18 which may be positioned in series between the orientation system and the ready gate G1. The drill bit or other article 10 to be sorted slides along the slideway 14 through a detection beam (e.g. an X-ray beam) which identifies the presence or absence of a certain material or materials in the article 10. This information is fed to a computer "B" and used together with physical information obtained from an optical micrometer 22 to determine the particular receiving station that is to receive the identified article. A control gate G3 may be positioned between the material detector 18 and the ready gate G1. A sensor S3 may be positioned to detect the presence or absence of an article 10 at the gate G2.

Figures 2, 3, 4, 5:
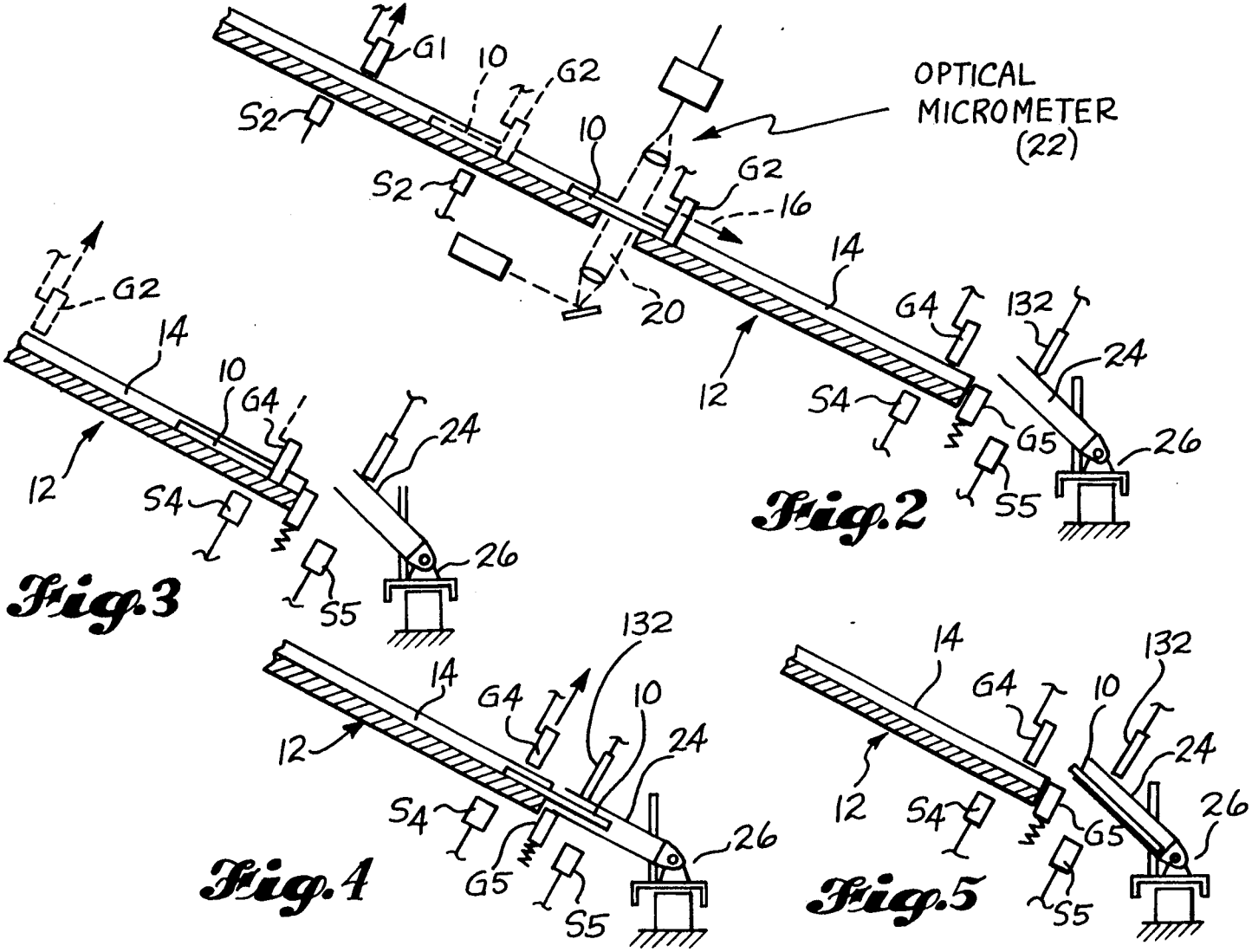
FIG. 2 is a view of a portion of FIG. 1, showing an article to be sorted in the process of being moved through a scanner beam of an optical micrometer.
FIG. 3 is a view of a portion of FIG. 1, showing the article at a load gate at the bottom of the gravity conveyor, in a position to be loaded into a carrier tube.
FIG. 4 is a view like FIG. 3, showing the article shortly following its loading into the carrier tube.
FIG. 5 is a view like FIGS. 3 and 4, showing the loaded carrier tube elevated and ready to be advanced along its travel path.

FIG. 2 shows ready gate G1 retracted out of the path of the article 10, allowing the article 10 to free slide down the slideway 14 into a position against the lead gate G2. The carriage 16 is then moved downwardly so as to move with it the lead gate G2 and the article 10. The article 10 is in this manner moved at a controlled rate of travel through a scanner beam 20 which is a part of the optical micrometer 22. As will hereinafter be described in detail, the pattern of interruption of the scanner beam 20 by the article 10 is used to produce an identification signal. When the carriage 16 reaches the lower end of its movement, the lead gate G2 is retracted, allowing the article 10 to continue free sliding down the gravity conveyor 12. It slides downwardly until it contacts another stop or gate G4 (hereinafter the "load" gate) which is positioned at the lower end of the conveyor 12. The article 10 stays in position against the load gate G4 until a receptacle portion 24 of a carrier unit 26 is moved into alignment with the slideway 14. Then, load gate G4 is retracted to allow the article 10 to slide into the receptacle 24 (FIG. 4). Then the receptacle 24, is swung upwardly free of the conveyor 12 so that it can be moved forwardly.

Proximity sensors S1, S2, S3, S4 are positioned immediately upstream of each gate G1, G2, G3, G4. These sensors S1, S2, S3, S4 detect the presence or absence of an article 10 at gates G1, G2, G3, G4 and send this information to a computer "A", the function of which is hereinafter described in some detail.

Carrier unit 26 is one of a series of like article carrier units 26 which are a part of an endless conveyor EC. The carrier units 26 are connected together and are movable in succession along an endless path. A carrier unit 26 starting from the article loading station at the lower end of the gravity conveyor 12, is moved by the endless conveyor EC along a path bordering a series of article receiving stations. Each article receiving station is associated with a particular species of article amongst the articles to be sorted. As will hereinafter be described in detail, the endless conveyor EC moves the carrier units 26 along the path in steps of a length equal to the spacing of the article receiving stations 30.

Each carrier unit 26 leaves the article loading station with the open end of its receptacle 24 directed upwardly at least an amount sufficient to prevent the article 10 from falling out from the receptacle 24. Each carrier unit 26 remains in this orientation until it has been moved by the endless conveyor EC into a position adjacent the particular receiving station for the particular species of article 10 that is in the receptacle 24. The identification signal generated by Computer "A" using data from the optical micrometer 22 (together with an identification signal from material detector 18 in a system including a material detector 18) is fed to computer "B". Computer "B" uses the identification signal to determine how many steps that each carrier unit 26 must move in order for it to be positioned adjacent the particular receiving station. 30 that is associated with the particular species of article 10 that is within its receptacle 24. When the carrier unit 26 reaches the position adjacent the related receiving station, computer "B" sends a control signal to a tip operator 28 (hereinafter described) at the receiving station which then functions to cause the receptacle 24 to tip into a position allowing the article 10 to fall out from it by gravity into a collecting pan 30 at the receiving station.

Figure 6:
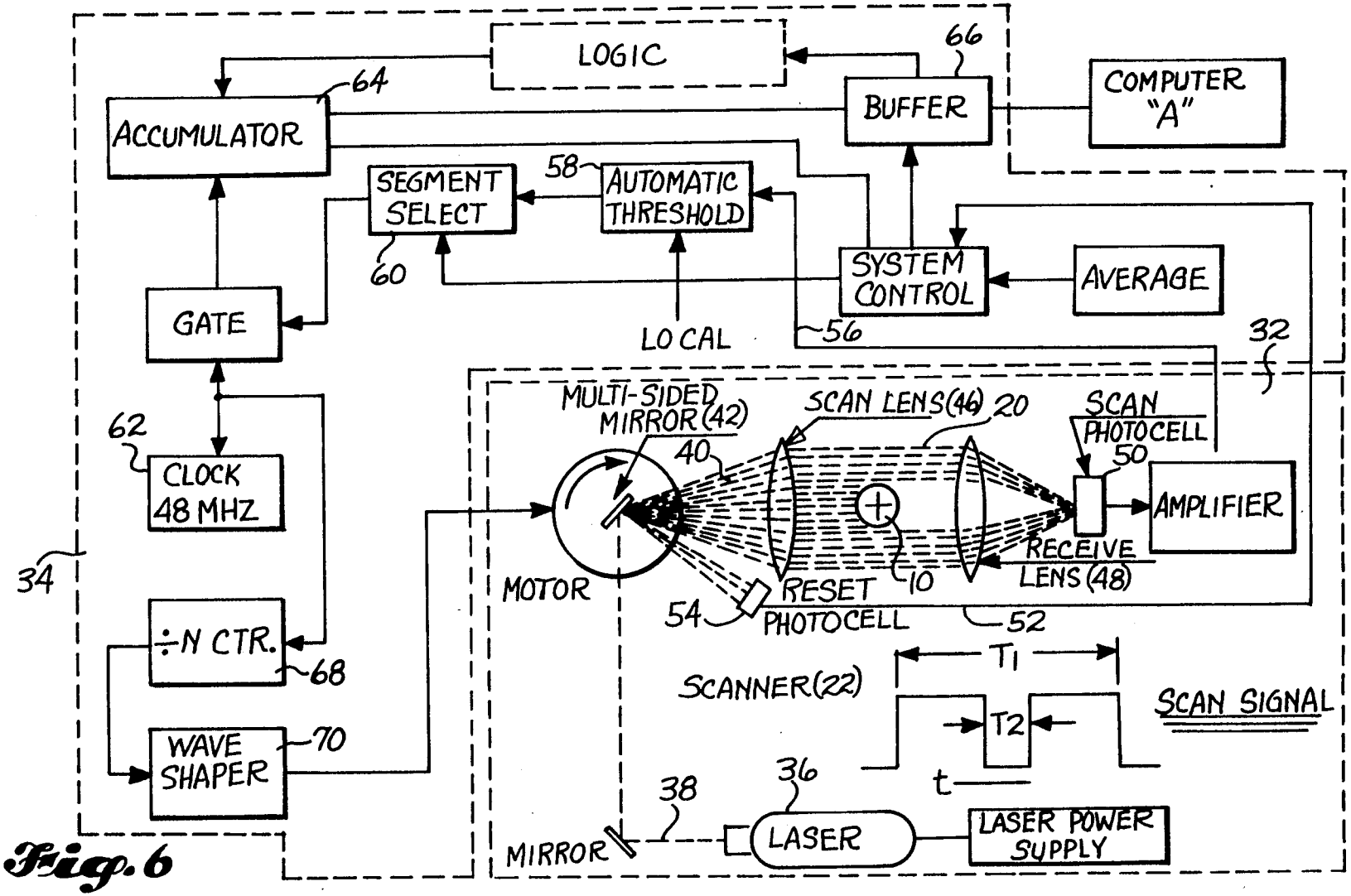
FIG. 6 is a schematic diagram of the optical micrometer.

FIG. 6 shows a functional block diagram of an example optical micrometer of a type manufactured by Techmet Company of 6060 Executive Boulevard, Dayton, Ohio 45424, and sold under the name LASER-MIKE TM. This particular optical micrometer 22 comprises a laser scanning section 32 and a control section 34. Optical micrometer 22 is capable of making fast dimensional measurements without physical contact with the articles being measured The laser scanning section 32 includes a low power helium-neon laser 36 which provides a very narrow and parallel laser beam 38, approximately 0.25 mm (0.01 inches) in diameter, for example. This beam 38 is converted to a radially scanned beam 40 by a motor driven multi-sided rotating mirror 42. The radially scanned beam 40 is converted into a parallel scanning beam 44 by means of a scan lens set 46, 48 oriented such that its focal point coincides with the center of the rotating motor driven mirror 42. The lens set 46, 48 is designed so that the parallel scanning beam 44 has a constant scanning velocity as it sweeps across the working area of the instrument. This scanning beam 44 provides the basis for making non-contact measurement.

A drill bit or other object 10 placed in the working area of the scanner beam 20 interrupts the scanner beam 20 for a period of time proportional to the object profile along the scan path. The scan may detect the article length, and/or diameter, and/or helical angle, and/or number of margins. The interrupted beam is collected by the receiving lens 48 and focused onto a photodetector 50 which converts the collected light to a time dependent signal labeled "scan signal" in FIG. 6. Time T1 represents the time during which the scanning beam is scanned across the working area WA while time T2 represents the time of the beam interruption due to the object 10 being measured.

This time dependent time signal is sent to the control section 34 along with a reset signal 52. The reset signal 52 is generated by a reset photodetector 54 which is located within the path of the internal scanning beam. The reset signal occurs immediately after the completion of each scan.

The control section processes the scan and reset signals and generates a digital signal corresponding to any dimension caused by beam interruption. The digitizing process begins by conditioning the scan signal 56 through an automatic threshold detector 58. The ratio of the threshold to the peak value of the scan signal is maintained at a constant level, allowing the detection of the scanned edge to be independent of laser power. The LO CAL adjustment may be used to vary threshold ratio so that small offsets in digitizing may be introduced for precise calibration.

A segment select monitor circuit 60 selectively gates the 45 MHz clock 62 into an accumulator 64. At the end of each scan the accumulator 64 contents increase by a number equivalent to the size of the scan segment that was selected. In the example of the scan signal shown in FIG. 6, if segment T2 was selected, the accumulated number would correspond to the diameter of the object 10 being scanned. A buffer circuit 66 outputs an identification signal to the computer "B." The scanner motor frequency is derived by a divide by N circuit 68 which reduces the clock frequency. A wave shaper 70 provides a nearly pure sine wave for the laser scanner.

The optical micrometer 22 is not per se a part of the invention. Rather, it is only important that an article identifying device be used which is capable of producing an identification as the article is being moved along a path which includes the device. In the illustrated embodiment wherein the articles being sorted are drill bits, it is advantageous to identify the following characteristics of the drill bits: shank type, maximum diameter, overall length, helix angle, back taper, number of margins, and the presence of a pilot.

Referring to FIGS. 7–11, in preferred form, the carriage 16 is mounted to slide along and be guided by an elongated guide rod 72. Carriage 16 includes a bearing 74 which engages the guide rod 72. Bearing 74 is carried by a side portion of the carriage 16 on one side of the slideway 14. On the opposite side of the slideway 14 the carriage 16 includes a lead nut 76 which includes internal threads which engage external threads on a lead screw 78. Guide rod 72 and lead screw 78 are parallel to each other and are both parallel to the slideway 14. The lower end of the lead screw 78 is connected to a reversible drive motor 80. The upper end of lead screw 78 turns within a stationary bearing 82.

As best shown by FIGS. 9 and 10, the gates G1, G2, G3, G4 are each preferably in the form of a pivotal arm having a free end portion 84 sized and shaped to fit within the slideway 14, in a position for blocking travel of the articles 10 along the slideway 14. The opposite end of each gate arm is attached to a rotary solenoid 86. By way of typical and therefore nonlimitive example, the rotary solenoid may be of a type marketed by Ledex, Inc. of Vandalia, Ohio, under the model number H-1082-029.

As shown by FIGS. 9 and 10, the rotary solenoids 86 rotate the gate arms forty-five degrees while moving them between their down and up or retracted positions. When a gate arm is in its retracted position, its end portion 84 is removed out from the slideway 14 and the drill bit or other object 10 is free to slide past it along the slideway 14.

Figure 7:
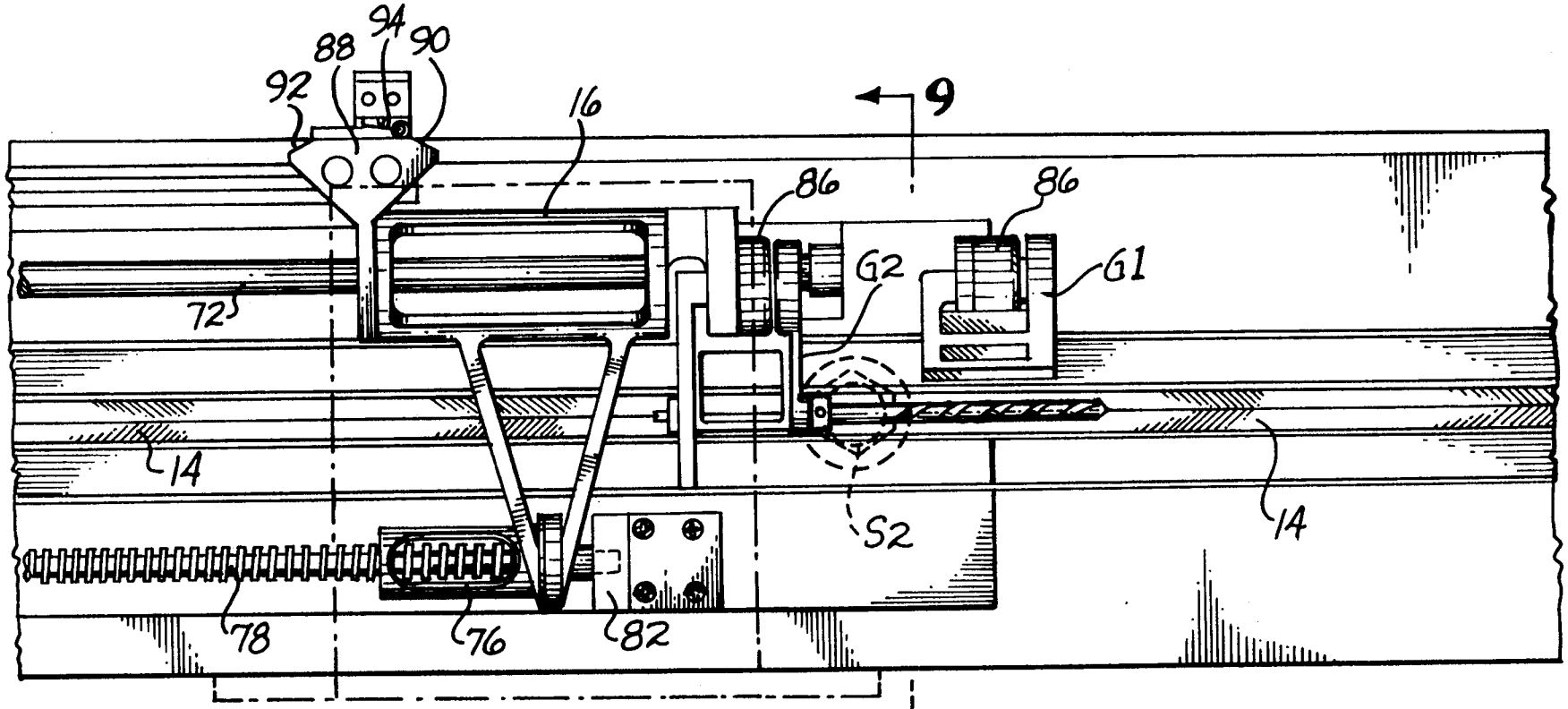
FIG. 7 is a top plan view looking normal towards a midportion of the gravity conveyor, at the start position of a lead gate which controls movement of the article to be sorted through the scanning beam, such view showing the ready gate upstream of the lead gate in a retracted position, and showing the lead gate in a down position, and further showing a lead nut portion of a carriage for the lead gate broken away to show a threaded engagement between the lead nut and a lead screw on which the lead nut travels.
Figure 8:
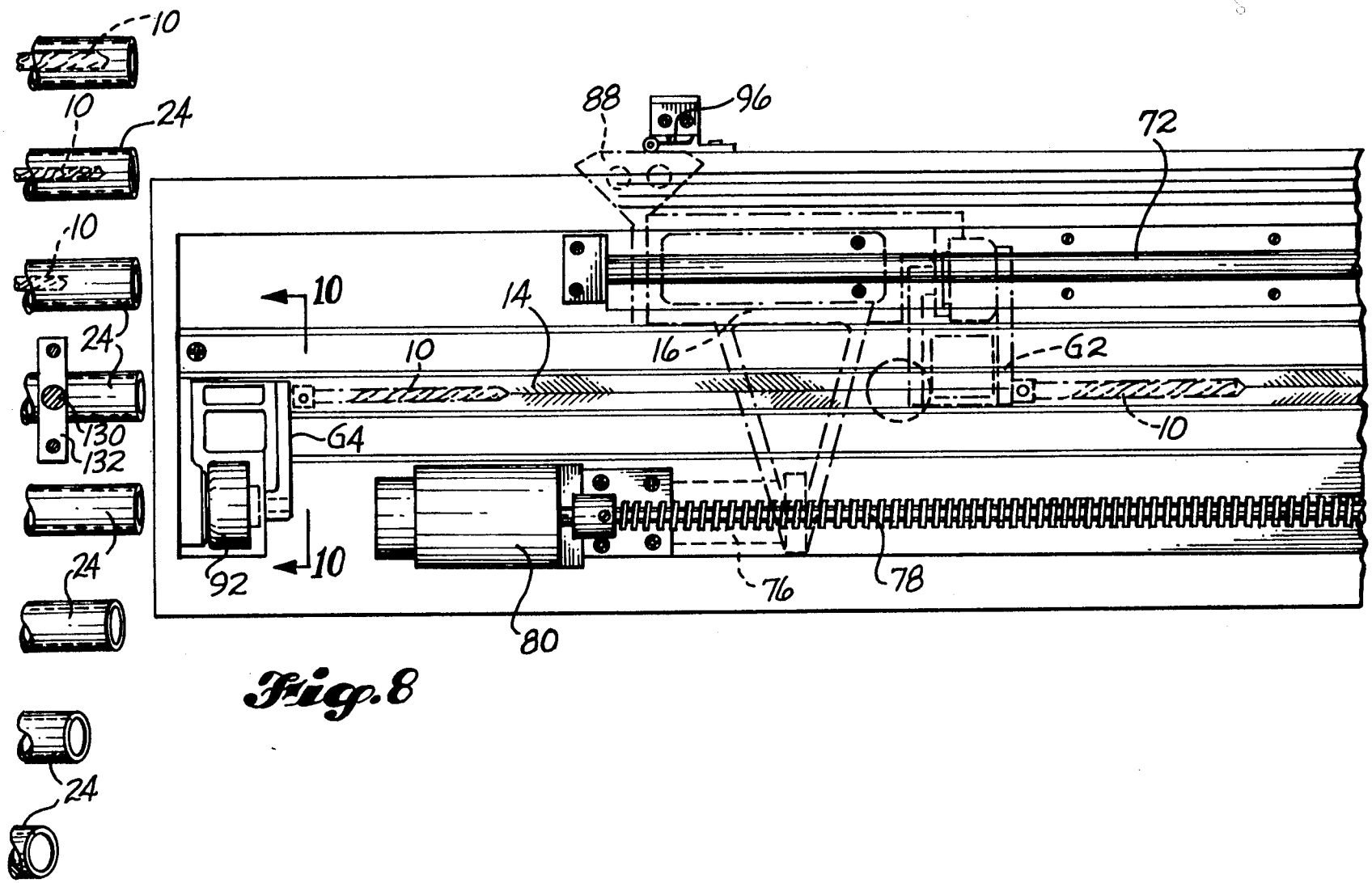
FIG. 8 is a view like FIG. 7, looking normal towards the lower end portion of the gravity conveyor, such view showing the advanced position of the lead gate and its carriage and showing a drill bit against the load gate at the lower end of the gravity conveyor.
Figure 11:
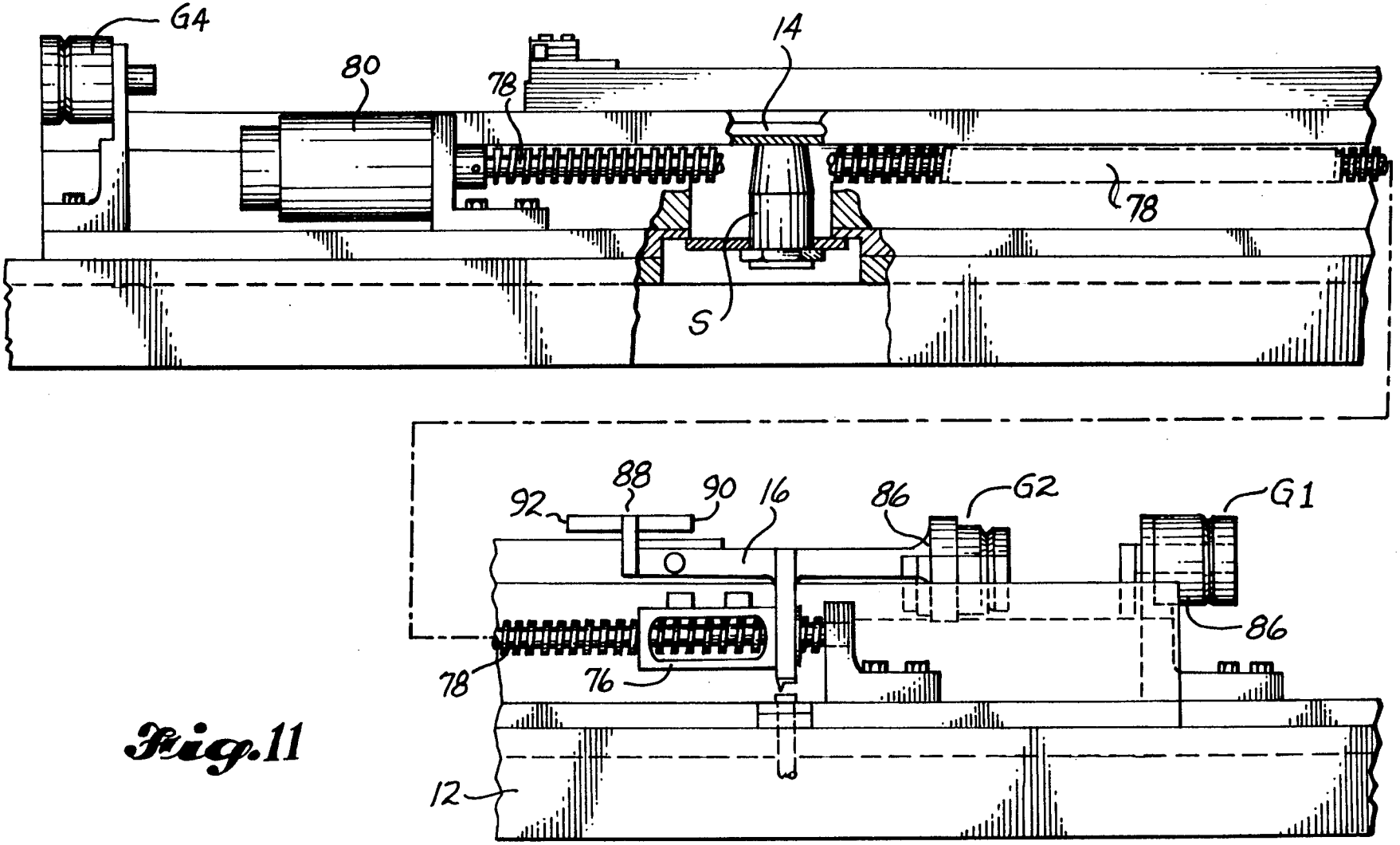
FIG. 11 is a side elevational view of the portions of the gravity conveyor shown by FIGS. 7 and 8, with foreground portions broken away to show detail that would otherwise be hidden from view.

Referring to FIGS. 7 and 8, the carriage 16 includes a limit switch operator 88, shown in the form of a member projecting laterally outwardly from the side of the carriage 16 which engages the guide rod 72. This projection includes a pair of limit switch contacting surfaces 90, 92 which are oppositely directed on the path of travel of the carriage 16. Surface 90 contacts and moves a first limit switch 94 when the carriage 16 is at the upper end of its path of travel (FIG. 7). Surface 92 contacts and moves limit switch 96 when the carriage 16 is at the lower end of its path of travel (FIG. 8). The limit switch system is provided for over travel protection only. The carriage is controlled by a closed loop servo system including the drive motor 80.

Referring now to FIGS. 12–17, the loading of an article 10 into a receptacle 24 will now be described. In the illustrated embodiment, the receptacles 24 are in the form of elongated tubes having a closed base end 98 which is pivotally attached to an upper portion 100 of a carrier unit 26. Each receptacle or tube 24 also has an open opposite end 102, into which and out from which, its article 10 is received and discharged. Hereinafter the receptacles 24 will be referred to as "tubes" or "carrier tubes" but will continue to be designated 24.

It is important that each tube 24 be in substantial axial alignment with its article 10 as such article is being delivered into the tube 24. In the illustrated embodiment, a gravity conveyor 12 is used and each tube 24 is positioned into substantial alignment with the slideway 14, shortly prior to the loading of the article 10 into its tube 24. In the disclosed embodiment, it is necessary that each tube 24 be movable upwardly to place the open end of the tube 102 above the side portion 104 of the conveyor 12 which is on the forward side of the path of travel of the tube 24. This is because some of the articles 10 delivered into the tube 24 may be longer than the receiving chamber in the tube 24, meaning that a portion of said article 10 will project outwardly beyond the open end 102 when the opposite end of the article is against the base wall of the chamber. The article 10 is delivered into the tube 24 when the tube 24 is in axial alignment with the slideway 14. Thus, the projecting portion of the article 10 is still within the slideway 14 and the sidewall 104 of the slideway 14 would be in the way of the projecting portion of the article 10 if the tube 24 were to be moved along the endless conveyor EC without first elevating it a sufficient amount to place the projecting end of article 10 above the sidewall 104.

Figure 25:
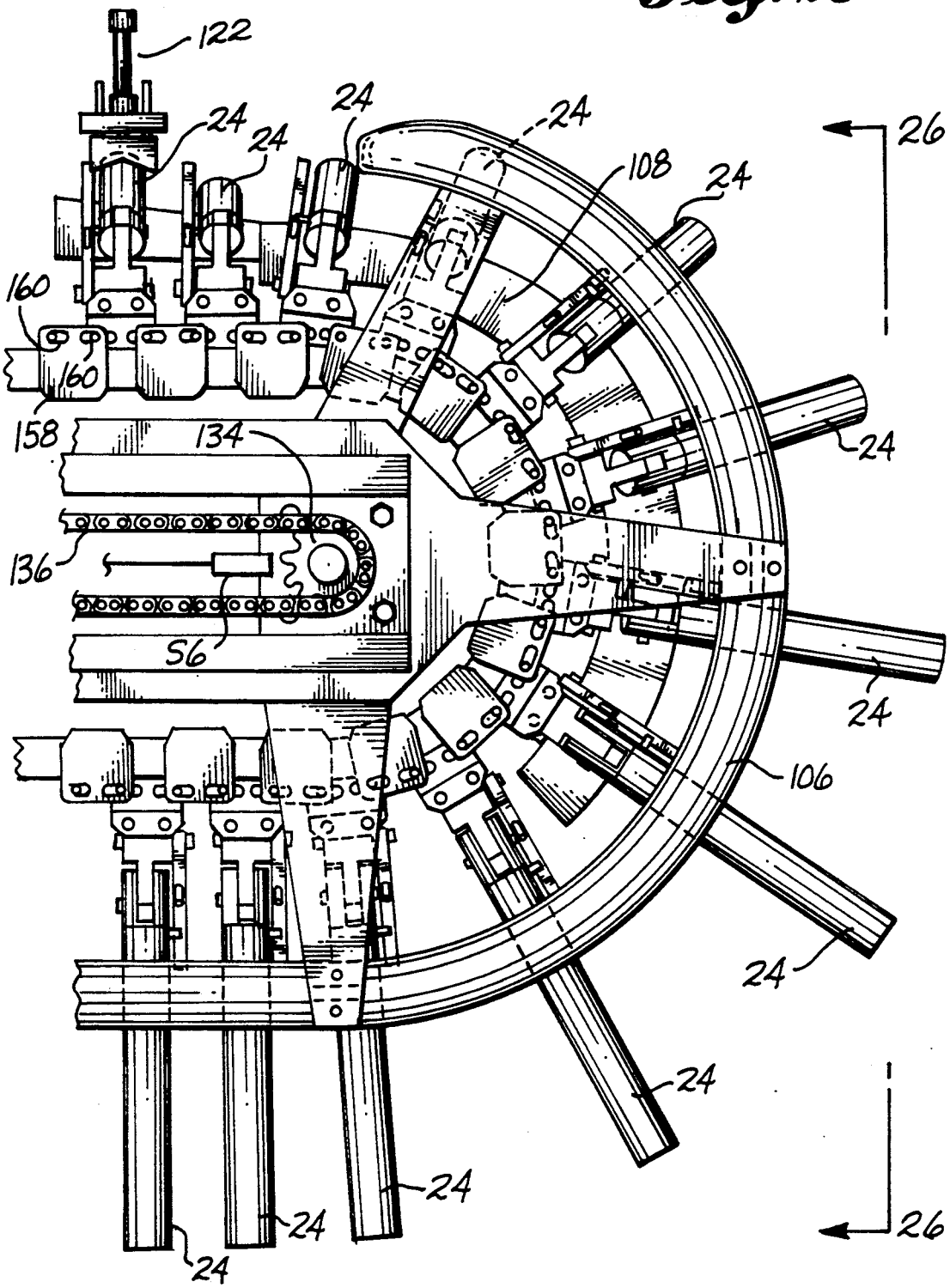
FIG. 25 is a fragmentary side view of an end portion of the endless conveyor from the side thereof opposite the side shown by FIGS. 12 and 13.

Referring now to FIG. 25, the tubes 24 are delivered to the load station along a path which includes a lower run in which the tubes 24 are directed downwardly. The tubes 24 are then swung upwardly along an arcuate end path into the start of an upper run. Gravity keeps the tubes 24 substantially within a vertical plane as they travel along the lower run. Tubes 24 as they move upwardly along the end path are contacted by a guide bar 106 which tips them over as they rise, towards the lower end of the gravity conveyor 12. Tubes 24 are tipped into contact with a guide rail having sections 108, 110, 112, in series within the upper run of the conveyor. (FIG. 15.)

Figure 12:
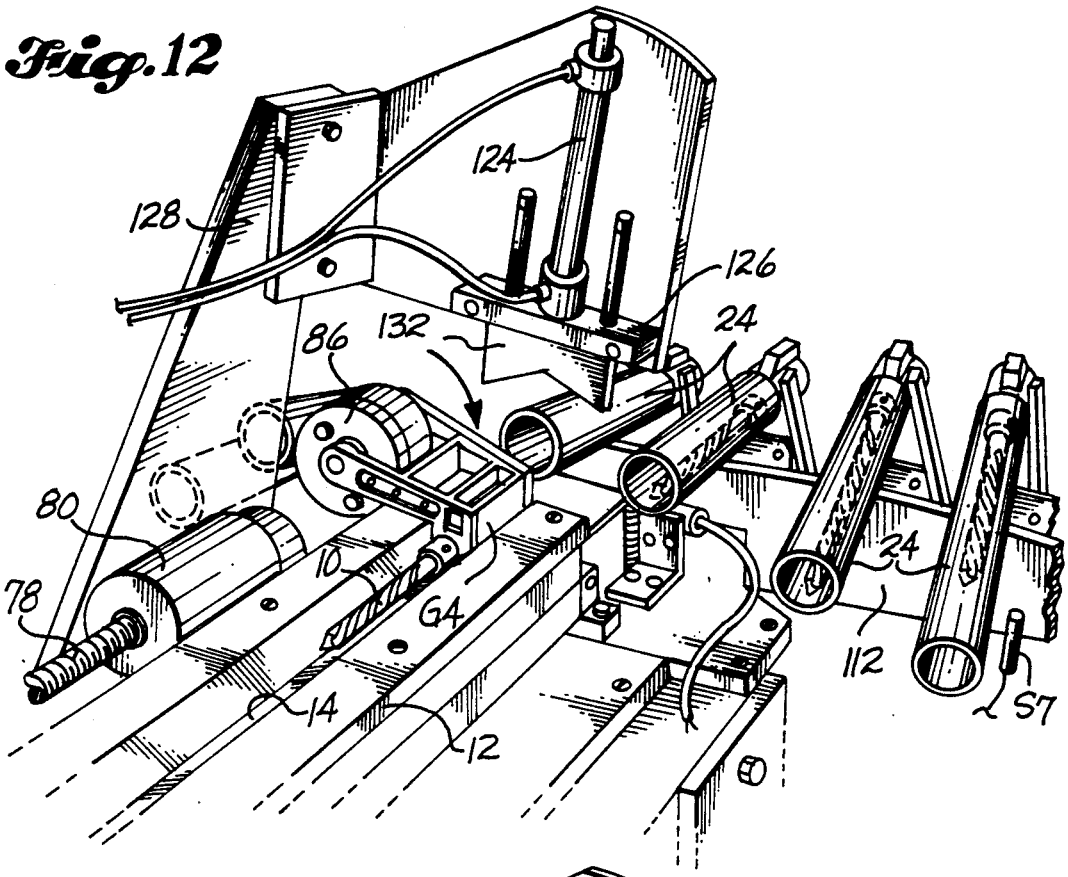
FIG. 12 is a fragmentary isometric view looking towards the lower end of the slide conveyor and the article loading station of the endless conveyor, such view showing the load gate in a down position and a drill bit against the load gate, and showing a carrier tube at the article loading station in an up position.
Figure 13:
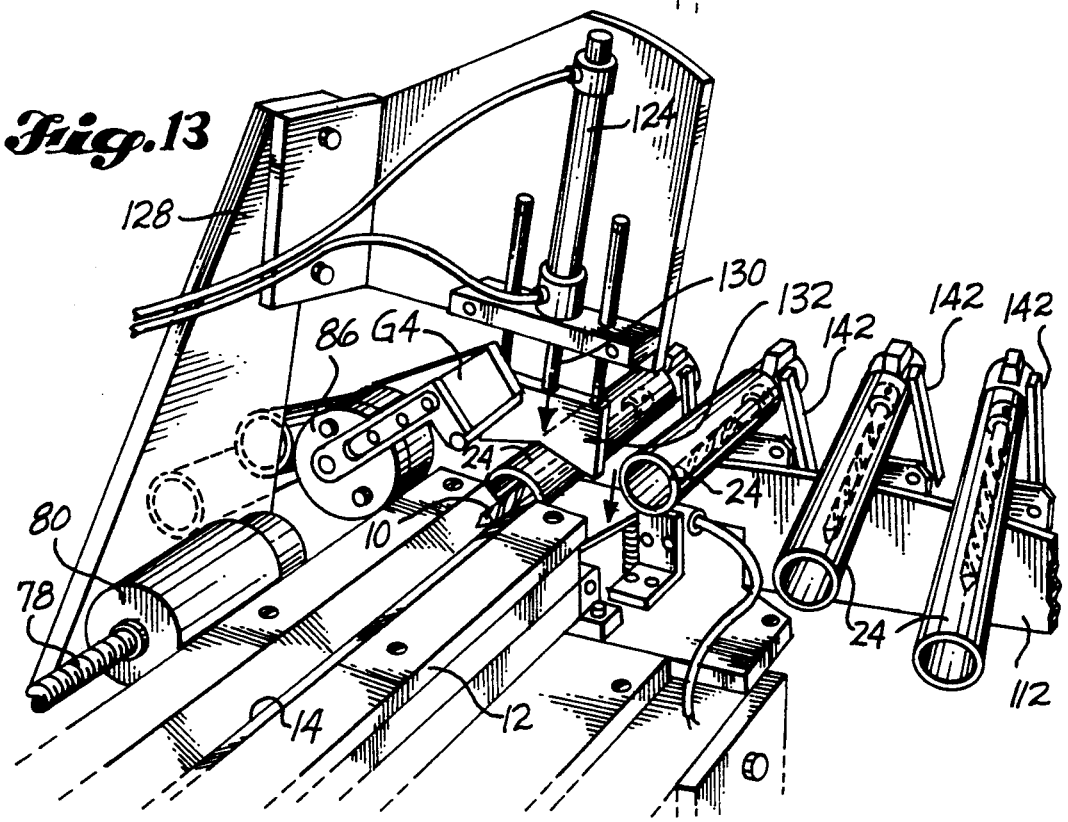
FIG. 13 is a view like FIG. 12, but showing the load gate retracted, the carrier tube at the article loading station depressed into a position placing its open end in axial alignment with the slideway of the gravity conveyor, and showing the drill bit in the process of sliding into the carrier tube.
Figures 14, 15:
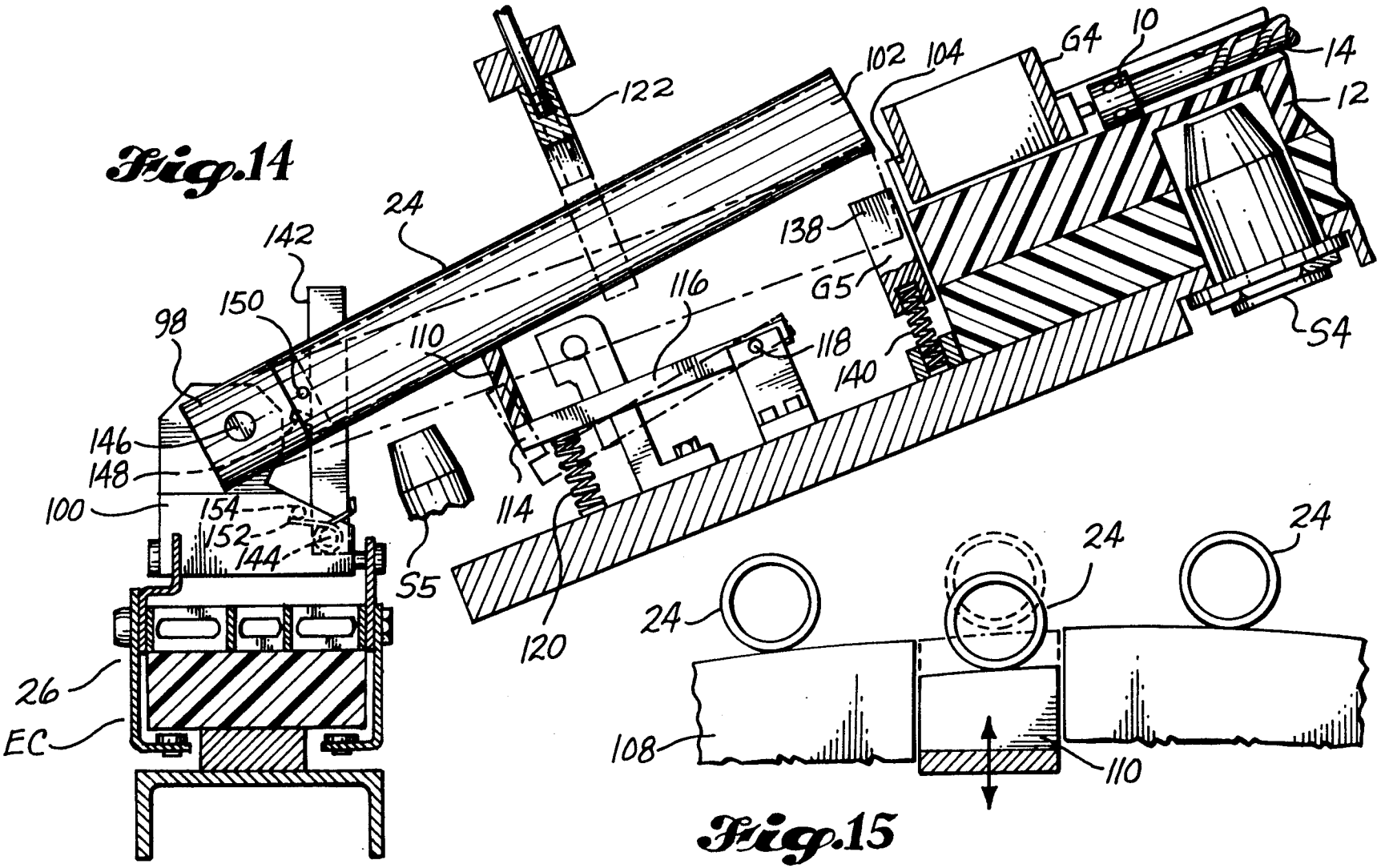
FIG. 14 is a sectional view taken through the endless conveyor and the lower portion of the gravity conveyor, at the article loading station, with some parts in side elevation, such view showing the load gate, the carrier tube at the article loading station and the drill bit in the same position as shown by FIG. 12.
FIG. 15 is a sectional view taken substantially along line 15—15 of FIG. 16.

As best shown by FIGS. 14 and 15, the guide rail section 108 elevates each tube 24 as the tube 24 travels along it. Guide rail section 110 is at the load station. When a tube 24 reaches guide rail section 110, it is in a position with its open upper end 102 elevated to be above slideway wall 104. Guide rail section 110 is movable vertically. In the illustrated embodiment, it is mounted at the free end 114 of a beam 116. The opposite end of the beam 116 is pivotally mounted at 118. A spring 120 normally biases the beam 116 upwardly, to place the upper edge of guide rail section 110 to where it continues the guide path established by the upper edge of guide rail section 108 over to the guide path established by the upper edge of guide rail section 112. As shown by FIG. 15, when the guide rail section 110 is in its up position (broken line position), the upper edges of the three rail sections 108, 110, 112 lie on a continuous smooth curve. A carrier tube 24 that is travelling on this curve has its open end 102 elevated a sufficient amount to place any projecting end portion of an article 10 within it above a slideway wall 104. As shown by FIG. 12, the mounted end of the load gate G4 is on the leading side of the tube path of travel. When it is in an up position (FIG. 13), its elevated end is sufficiently out of the way of any projecting end portion of an article 10 within a loaded tube 24, when the loaded tube 24 is elevated to place it on guide rail section 112.

As stated above, spring 120 normally biases beam 116 upwardly so as to place the guide rail section 110 in its upper position. A depress unit 122 is provided at the load station. It comprises a fluid actuator, such as an air cylinder 124, or a suitable equivalent structure. The actuator 124 is mounted onto a frame member 126, such as by use of a mounting bracket 128. Actuator 124 includes an extendible/retractable element 130 (e.g. piston rod, the lower end of which is connected to the depress element 132.

As shown by FIGS. 12 and 14, a tube 24 is moved into the load station with its upper end elevated. At this time the load gate G4 is in a down position and if an article 10 is at the lower end of the slideway 14, its leading end is in contact with an end portion of the load gate G4 which is in the slideway 14. The aforementioned sensor S4 determines the presence or absence of an article 10 at the load gate G4. The system also includes a sensor S6 which determines that a tube 24 is in a stopped position at the load station and is thus ready to be depressed to receive an article 10. The sensor S6 may be conveniently associated with a gear 134 which engages a control chain 136, the function of which will hereinafter be described in some detail. At the present time, it is sufficient to say that whenever a tube 24 is in a stopped position at the load station, a tooth of the gear 134 (FIG. 25) is positioned in alignment with the sensor S6. The sensor S6 is a proximity sensor and when it is in alignment with a tooth of the gear 134, it sends a signal to the control mechanism for the depress actuator 124, letting it know that a tube has reached the load station and has stopped. The purpose of sensor S6 and the function which it performs is to prevent depress element 132 from being moved downwardly while the tubes 24 are still moving.

Figure 16:
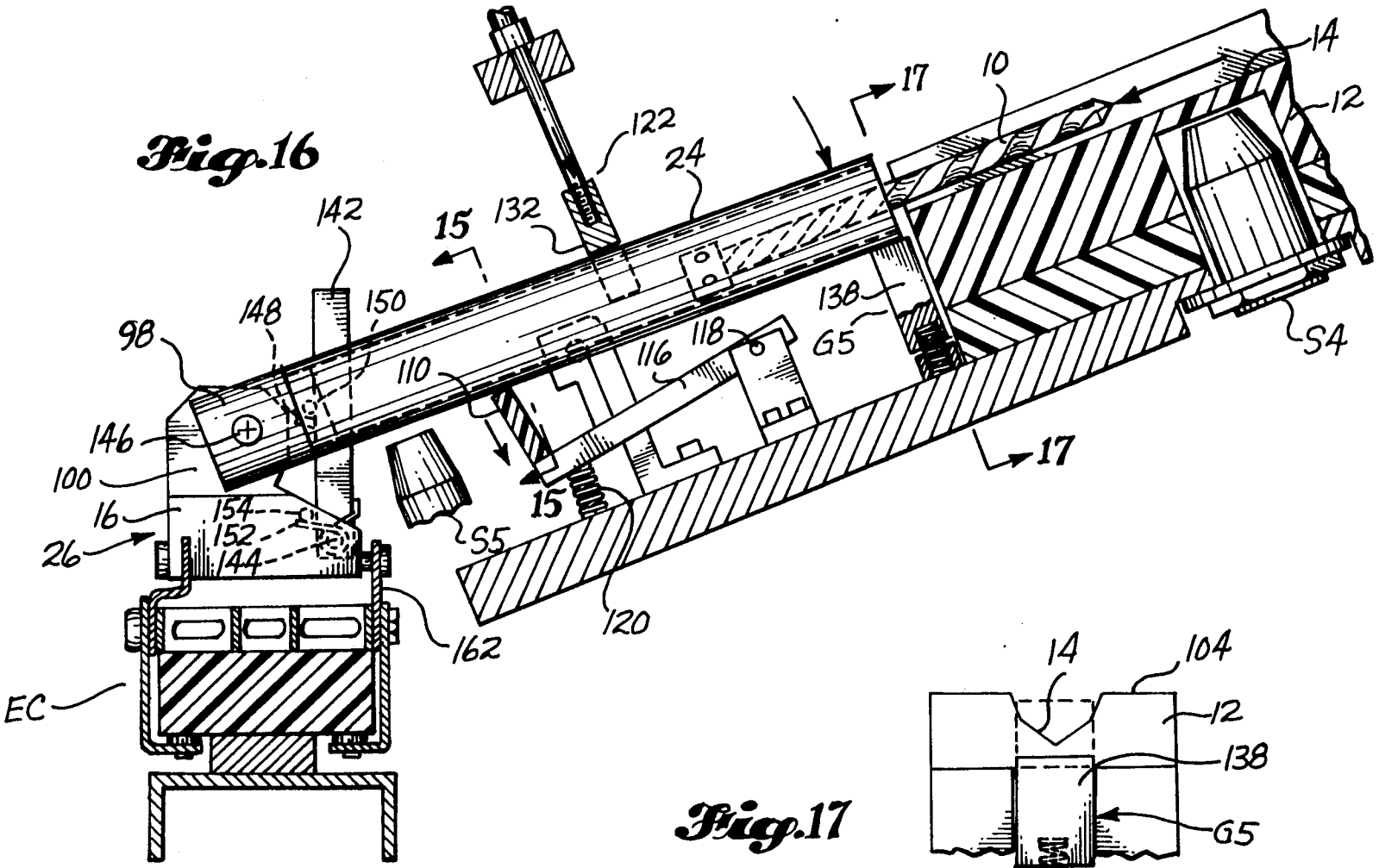
FIG. 16 is a view like FIG. 14, but showing the carrier tube and the drill bit in the same position as shown in FIG. 13.
Figure 17:
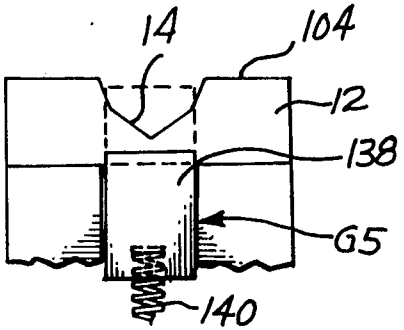
FIG. 17 is a sectional view taken substantially along line 17—17 of FIG. 16, including a solid line showing of a load prevent gate at the lower end of the slideway in a retracted position, and a broken line showing of the load prevent gate in an extended position.
Figure 18:
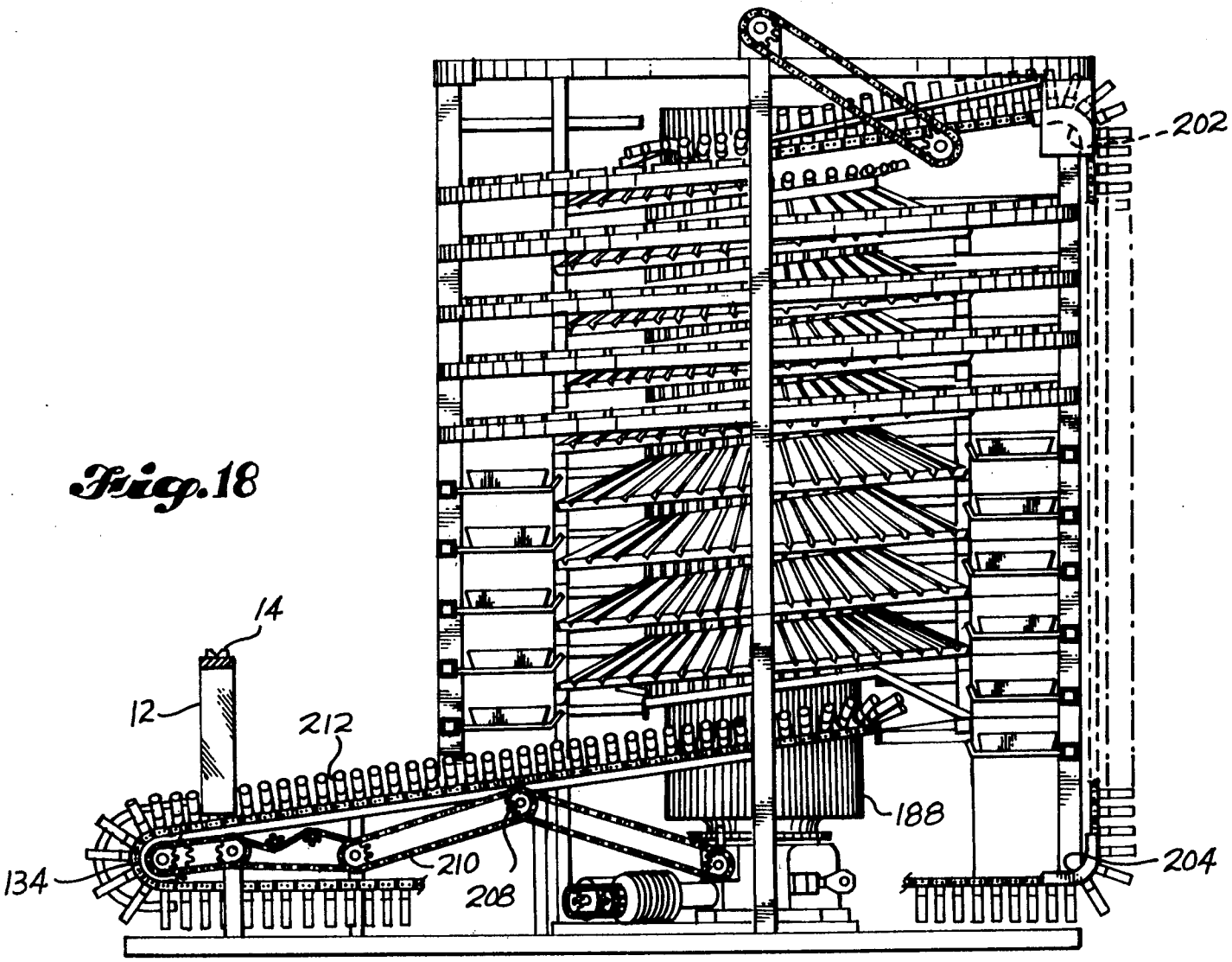
FIG. 18 is an elevational view of the sorted article receiving portion of the system, with foreground portions of the mechanism omitted for clarity of illustration of other portions that would otherwise be hidden from view.

A prevent gate G5 is positioned endwise of the lower end of the gravity conveyor 12. It comprises a stop member 138 that is normally biased upwardly by a spring 140. As shown by FIGS. 14 and 17, when the stop member 138 is in its up position, it is in a position to block movement of an article 10 out from the slideway 14. The purpose of stop G5 is to prevent a second article 10 to be delivered out from the slideway while gate G4 and a loaded tube 24 are both in an up position. As shown by FIG. 16, a tube 24 that has been moved downwardly by the depress element 132 will in turn depress the prevent gate 138. Then, when depress element 132 is retracted, allowing spring 120 and elements 110, 116 to elevate the tube 24, the spring 140 extends the stop element 138 upwardly as the tube 24 is moving away from it.

Sensor S5 detects the presence of an article 10 within a tube 24 and sends a control signal which allows the depressed element 132 to be retracted and the loaded tube 24 to be moved to the next step.

Each carrier unit 26 includes a brace arm 142 which is pivotally attached at its lower end, at location 144, to the member 100. The pivot axis at pivot 144 is parallel with the pivot axis 146 at the closed end 98. Each arm 142 includes a limb 148 projecting generally laterally from the arm 142, towards the pivot axis 146. A pin 150 projects laterally from the tube 24 at a location spaced longitudinally of the tube from the pivot axis 146. The limb 148 and the pin 150 are so positioned that when the pin 150 is positioned within a nook formed by the arm 142 and the limb 148, the tube 24 is braced into a position with its open end 102 elevated to such an extent that an article within the tube 24 will not gravitate out from the tube 24. A torsion spring 152, at the lower end of arm 142, biases the arm 142 into a substantially upright position. The torsion spring 152 includes a loop which surrounds pivot pin 144. One end of spring 152 is captured under a pin 154 carried by member 100. The opposite end of spring 152 is bent to lap partially around a lower portion of the arm 142, on the side of the arm 142 opposite the pin 154. Owing to this arrangement, the spring 152 biases the arm 142 towards the pin 154. This places the arm 142 into a substantially upright position.

Following a loading of an article 10 within a tube 24, the depress element 132 is retracted, allowing spring 120 to move the loaded tube 24 upwardly. The up and down movement of the tube 24 at the loading station moves the pin 150 in position relative to the limb 148 but does not change the position of the arm 142. As the loaded tube 24 takes its next step, it moves off from guide rail section 110 onto guide rail section 112. As best shown by FIGS. 12, 13 and 15, the upper edge of rail section 112 first flattens out and then curves downwardly as it extends away from the rail section 110. A loaded tube 24 initially rides on the upper edge of rail section 112 as it moves away from the rail section. When the tube 24 encounters the downwardly curving portion of the edge, it falls downwardly to follow the edge until its pin 150 contacts the limb 148 on its arm 142. Then, the attitude of the tube 24 will be established by the brace arm 142.

If, in some manner, a brace arm 142 is tipped out of position so that its limb 148 does not engage the pin 150, the tube 24 will continue in contact with the upper edge of rail section 112 and will continue to drop in position as the upper edge of rail section 112 curves downwardly. In order to prevent this from happening, a sensor S7 (FIG. 12) is positioned laterally outwardly from rail section 112 at a location where each tube 24 should be elevated above the upper edge of the rail section 112. If a pin 150 and limb 148 have not engaged, and the tube is still down on rail section 112, the sensor S7 will detect this condition and send a "stop" signal to computer "B" and computer "B" will in turn stop the conveyor and signal an operator to manually raise the tube 24 and engage its pin 150 with the limb 148 of its position arm 142.

For purposes of this invention, it is only important that the endless conveyor EC deliver the contents of the filled tubes 24 to the appropriate station of the receiving stations which border the path of travel of the endless conveyor EC as it makes a closed loop from and then back to the loading station. The particular system that is illustrated was constructed to handle and sort a large number of species of the articles 10. Accordingly, it was necessary to provide a large number of receiving stations for the articles. This was conveniently done by positioning the receiving receptacles to one side of a helical path and then making the endless conveyor travel the helical path. This arrangement made a good utilization of available space. The helical path was developed about a vertical axis and thus it became possible to position a large number of receiving receptacles within a small area of floor space. In some other installation it may be desirable to position the receiving receptacles in a different manner. Accordingly, it is only important to this invention that the receiving station be positioned alongside the path of travel of the endless conveyor. The helical pattern, and the construction of the mechanism used to establish the helical pattern, form the subject matter of the aforementioned copending application Ser. No. 07/269,991, entitled "Storage Mechanism For Sorted Articles", now U.S. Pat. No. 4,924,998. The helical pattern is presently preferred and for this reason, is illustrated and described herein.

Figure 21:
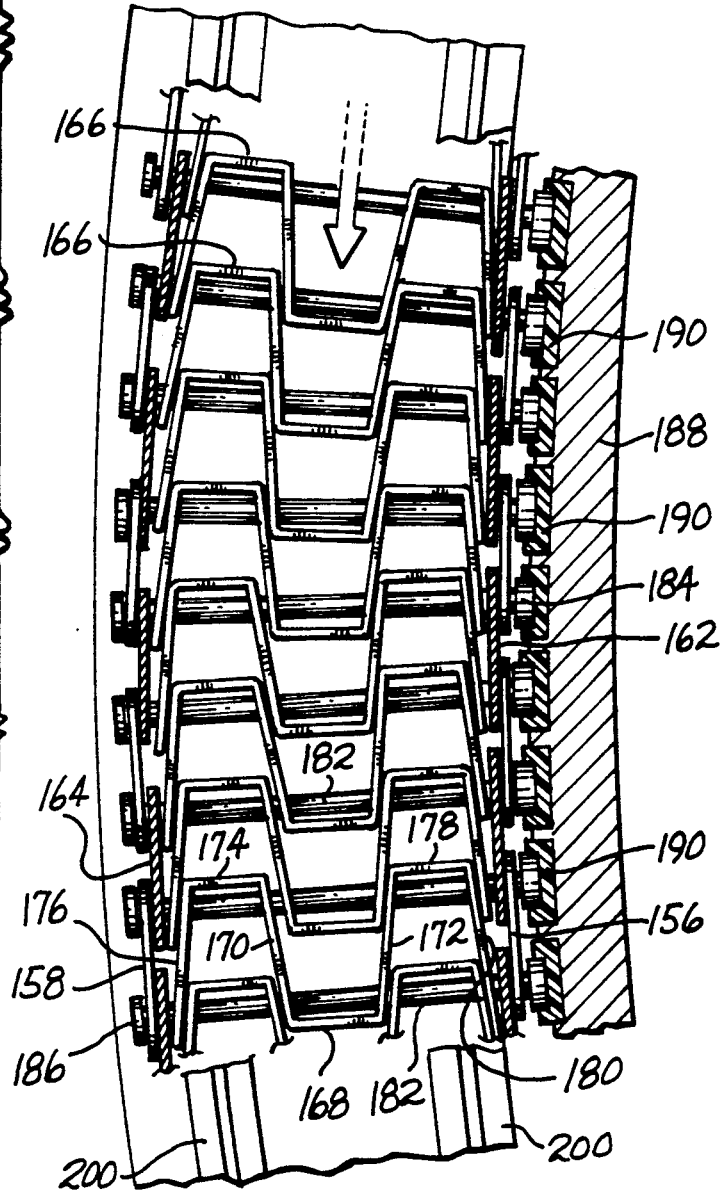
FIG. 21 is a fragmentary top plan view of a carrier chain portion of the endless conveyor, showing a drive engagement between the drive drum and the carrier chain.

As shown by FIGS. 14, 16, 21 and 25, the endless conveyor EC is composed of a chain-like flexible member comprising a series of pairs of side plates 156, 158. The upper portions of the side plates 156, 158 include slots 160 which are aligned with each other in the direction of conveyor movement (FIG. 25). The base frames 100 of the carrier units 26 are each positioned laterally of the conveyor path, between links 162, 164 which have slotted lower portions. A plurality of bent thin metal segments 166 are disposed laterally between the links 162, 164. Each segment 166 comprises a U-shaped central portion defined by an end member 168 and side members 170, 172. Side member 170 is connected to an end member 174 and end member 174 is connected to a side member 176. In similar fashion, side member 172 is connected to an end member 178. End member 178 is connected to a side member 180. End member 174 and side members 170, 176 form a U-shape portion which is on one side of the U-shaped portion 168, 170, 172, and oppositely directed. End member 178 and side members 172, 180 form another U-shaped portion on the opposite side of U-shaped portion 168, 170, 172, which is also oppositely directed. The side members 170, 172, 176, 180 all include slots which are elongated in the direction of travel of the conveyor. Connector pins 182 extend through the slots in the side members 170, 172, 176, 180 and also through the slots in the side plates 156, 158 and through the slots in the links 162, 164. A first head 184 is provided at a first end of each pin 182. A second head 186 is provided at the opposite end of each pin 182. As best shown by FIG. 21, the U-shaped portions of the links 166 nest in each other and in their nested position they form a chain-like structure which is braced laterally of the path of travel while at the same time allowing up and down bending movement of the chain and also allowing the chain to travel around a curved path. The slots allow the plates 158 and the links 164 on the outside of the curve to move relatively apart and at the same time the slots on the inside of the curve allow the plates 156 and the links 162 to move relatively closer together. The slots in the segments 166 allow relative movement between the connector pins 182 and all of the slotted parts. This construction of a flexible conveyor element is not per se a part of the invention. Flexible conveyor elements of this general construction are known in the art. For example, see U.S. Pat. No. 4,078,655, granted Mar. 14, 1978, to Gerald C. Roinestat.

Figure 20:
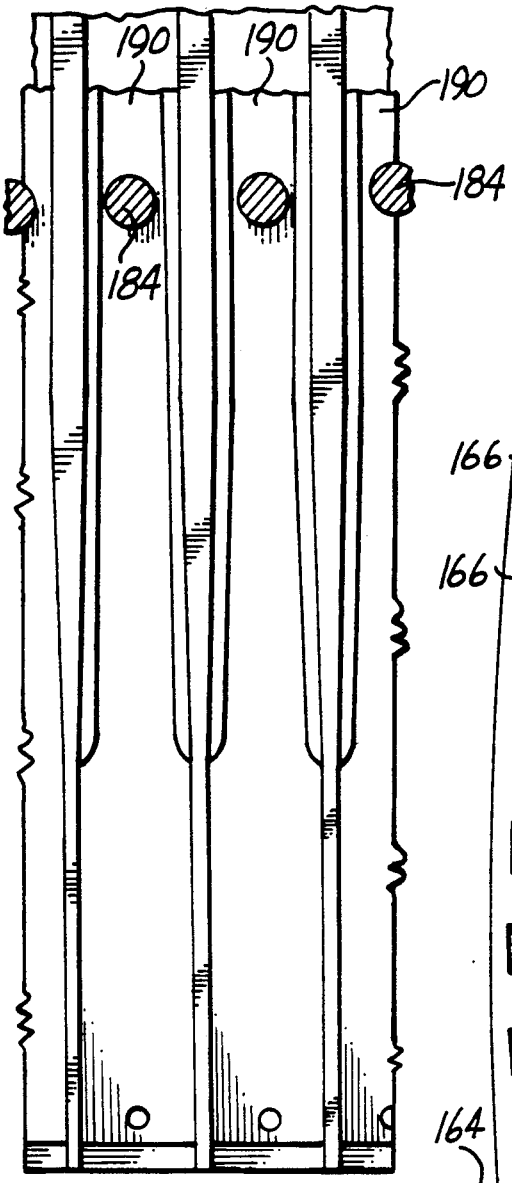
FIG. 20 is a fragmentary elevational view of a drive drum portion of the endless conveyor.
Figure 22:
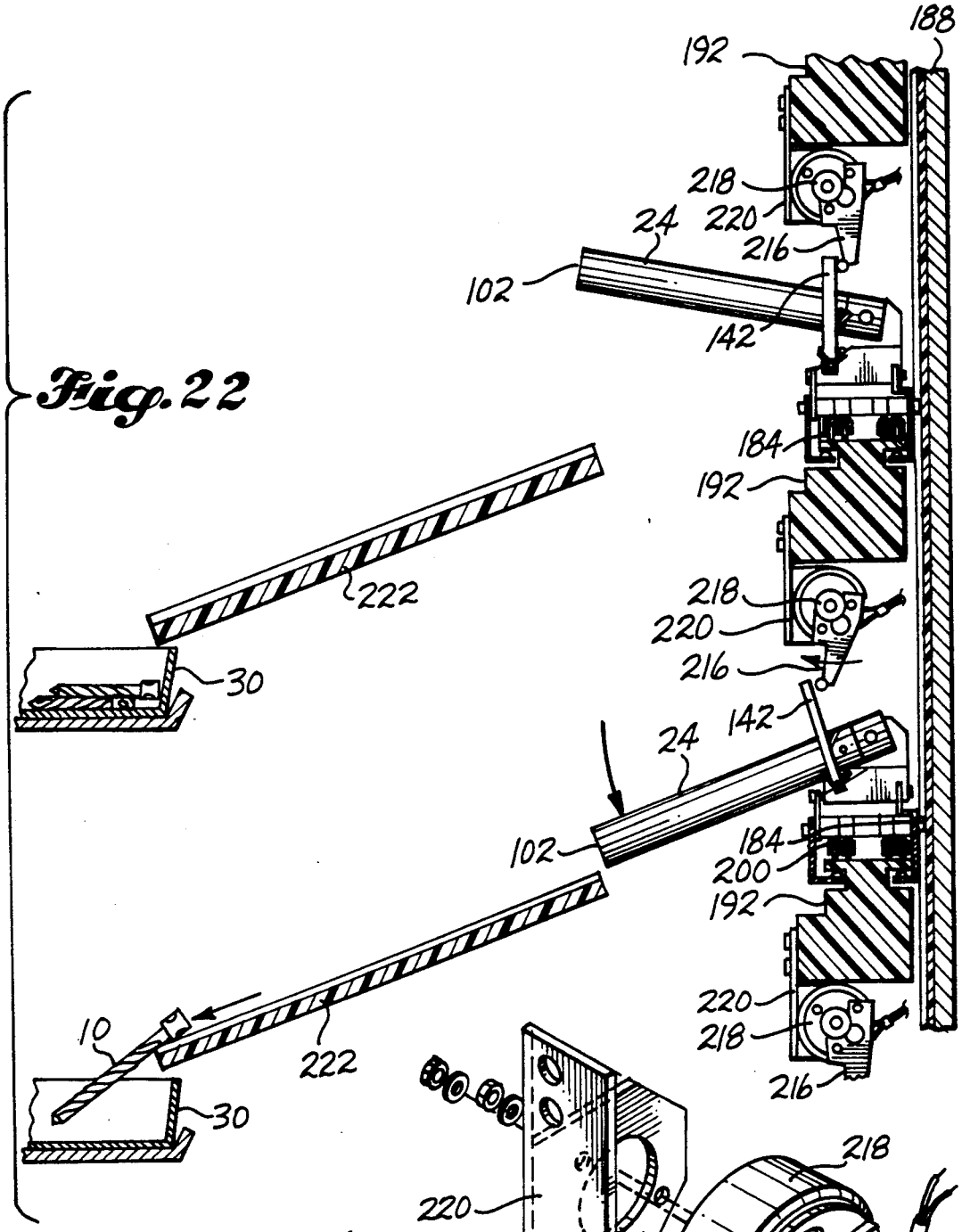
FIG. 22 is a fragmentary sectional view taken substantially along line 22—22 of FIG. 19, with some parts shown in side elevation.
Figure 23:
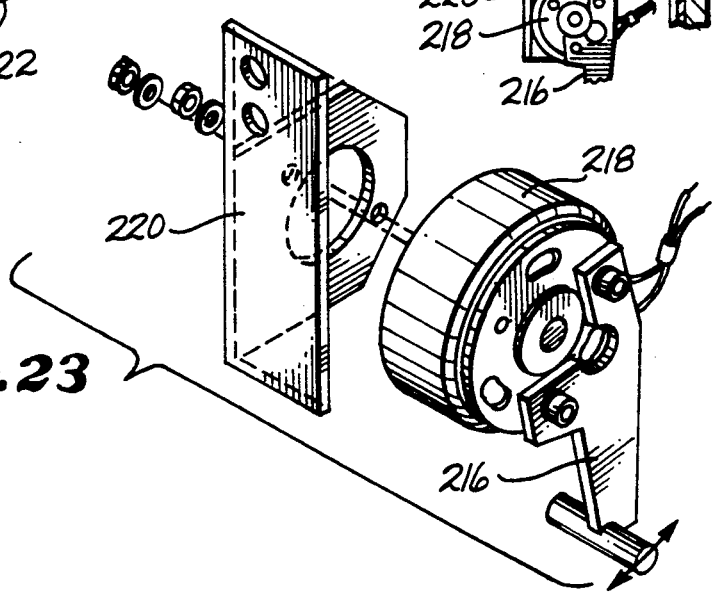
FIG. 23 is an enlarged scale isometric view of an operator for operating a carrier tube release mechanism.

In the illustrated embodiment, a vertically elongated drum 188 is provided, and such drum 188 is supported for rotation about a vertical axis. As shown by FIGS. 20 and 22, the drum is constructed to provide a plurality of vertically disposed channels 190 into which the pin heads 184 are received. A drive mechanism at the lower end of the drum 188 rotates the drum 188 in steps, each of which is substantially equal to the spacing of the carrier tubes 24. The upper run of carrier tubes 24 extends from the loading station to the drum along a relatively straight path which slopes upwardly at an angle equal to the pitch of the helical path of travel of the endless conveyor EC. The pin heads 184 approach the lower portion of the drum 188 along a tangent and then mesh with the channels 190, in the manner that gear teeth mesh with each other. Accordingly, the rotating drum becomes the drive member for the endless conveyor EC. The step-by-step rotation of the drum 188 is transmitted by the walls of the channels 190 to the pin heads 184. Preferably, the channels 190 are constructed from a self-lubricating plastic material for the purpose of cutting down on the friction between them and the pin heads 184.

Figure 24:
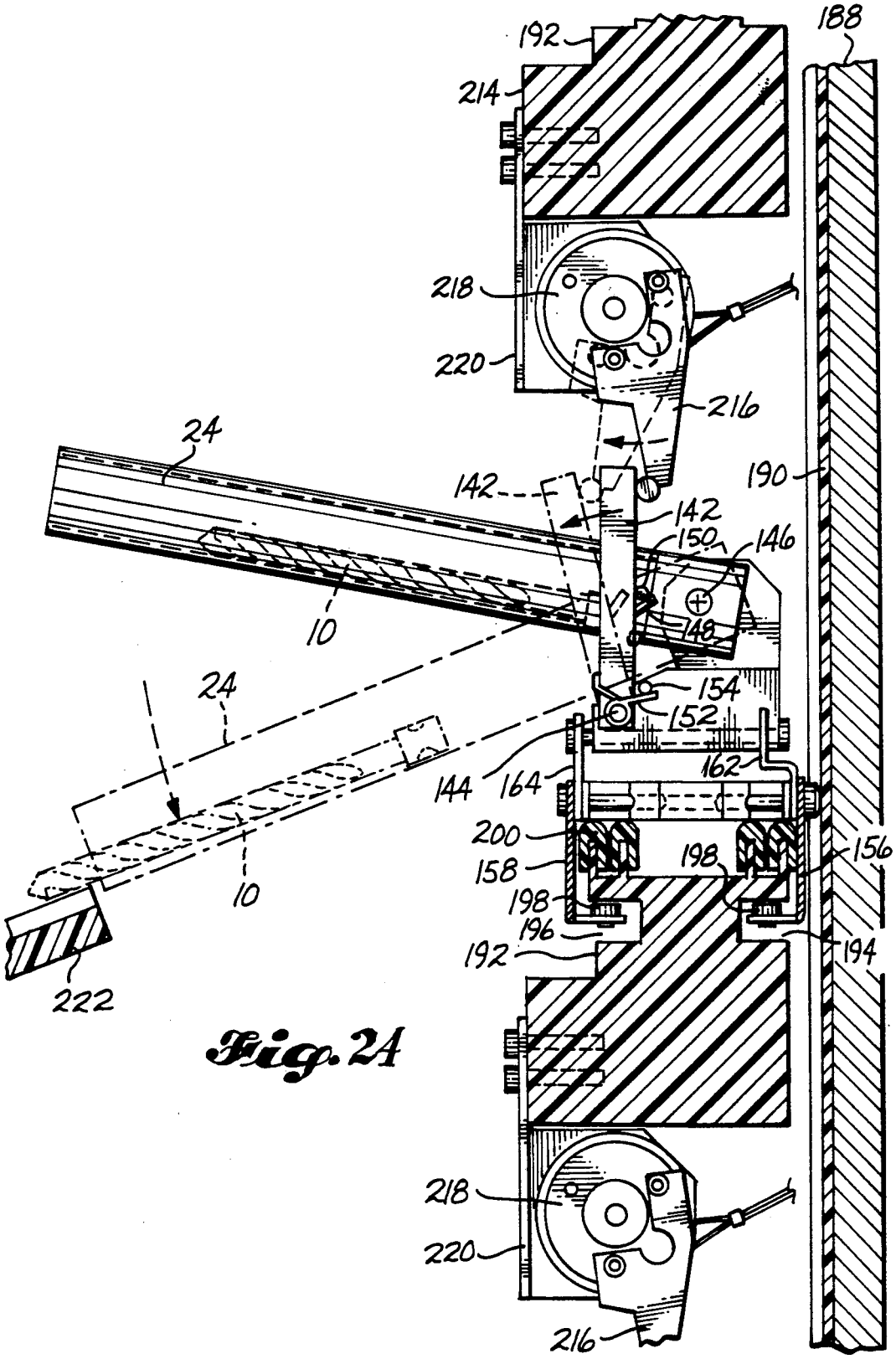
FIG. 24 is a fragmentary view of a carrier unit, including a solid line showing of the carrier tube in its carry position and a broken line showing of the carrier tube in its discharge position.

A helical track, constructed from sections, is provided around the rotating drum 188. This track is fixed in position and the flexible conveyor element slides on it. The cross-sectional configuration of the helical track sections 192 is shown in FIGS. 22 and 24. The track sections 192 have side grooves 194, 196, into which extend the lower portions of the conveyor plates 156, 158. These lower portions turn in towards each other and each preferably carries a button 198 constructed from a self-lubricated material. This is for the purpose of minimizing wear between the buttons 198 and the track section 192.

The track sections 192 include four plastic wear-stripes 200 on which the conveyor segments 166 ride. The track sections 192 curve about the drum 188 and define a helical path along which the endless conveyor EC travels as it extends upwardly around the drum 188. When the endless conveyor EC reaches the upper end of the drum 188, it winds off from such drum at a tangent and is then guided over a curved guide block or bearing 202. It then extends vertically downwardly from block 202 to a lower curved guide block or bearing 204. It bends around block 204 and then extends as the aforementioned lower run until it reaches the curved path which brings it back up to the loading station.

Figure 19:
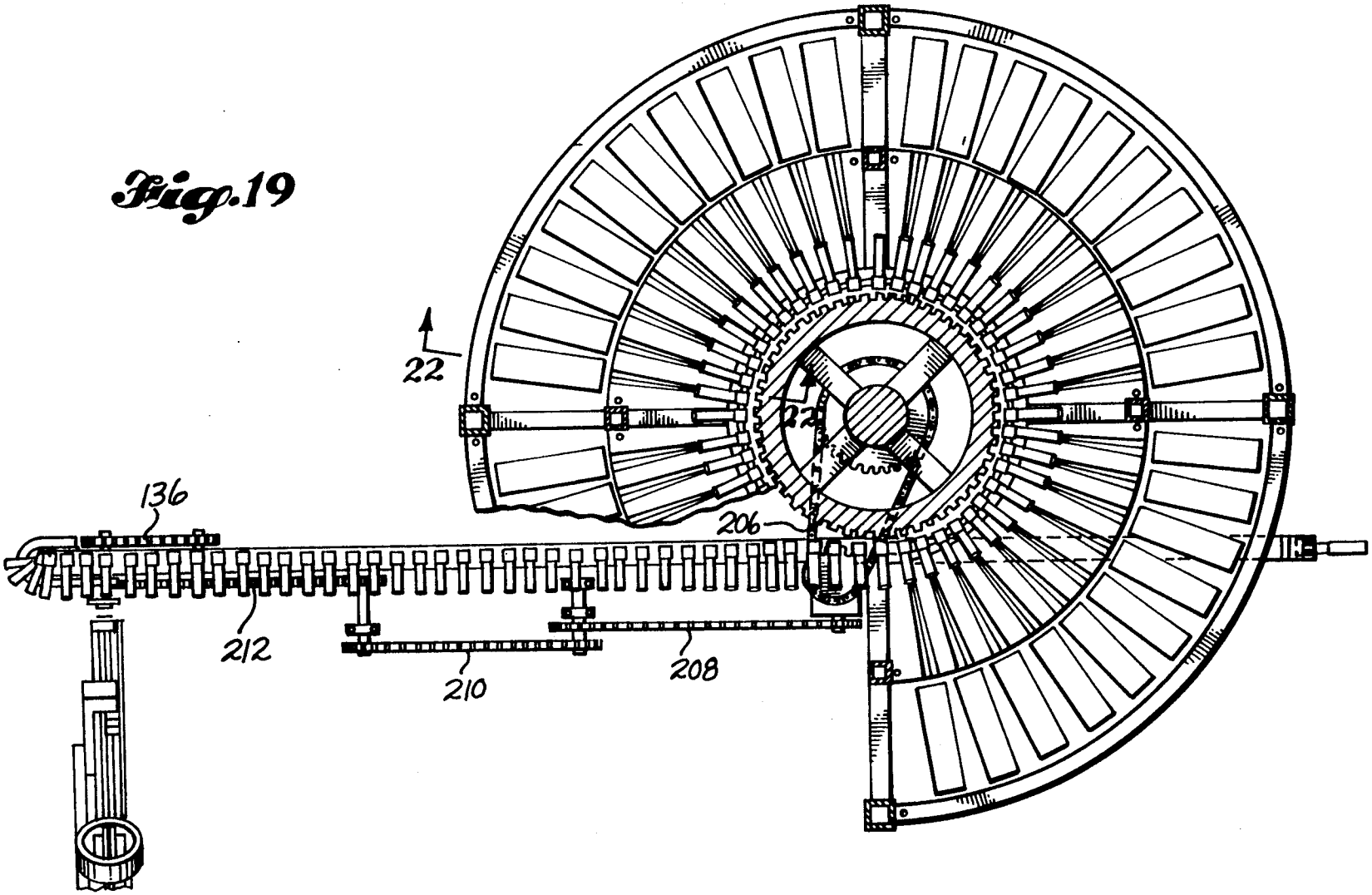
FIG. 19 is a top plan view of the mechanism shown by FIG. 18 with an upper portion removed for purposes of better illustrating lower portions of the mechanism below it.

A series of chains and sprockets extend between the drum 188 and the drive gear 134 (FIG. 25). In FIG. 19 the trains are designated 206, 208, 210, 212, 136. The purpose of this drive train is to coordinate rotation of the drum 188 with the positioning of the carrier tubes 24 at the loading station. The chain and sprocket drive train causes the filled carrier tubes 24 to be moved forwardly from the loading station a distance equal to the spacing between the tubes at the same time that the drum 188 moves one step equal to the spacing between tubes 24. A similar timing drive is provided at the upper end of the drum to time the movement of carrier tubes 24 off from the drum 188. Specifically, drum 188 may be connected to drive a sprocket 213. Sprocket 213 drives a chain 214 which in turn drives a sprocket 215. Sprocket 215 drives a gear (not shown) which meshes with the conveyor chain.

FIG. 22 is a fragmentary vertical sectional view of a central portion of the collection bin assembly. It shows that the rotating drum 188 is outwardly bounded by support track sections 192. The support track sections 192 are fixed in position relative to the rotating drum 188, by a frame structure that is disclosed and fully described in the aforementioned copending application entitled "Storage Mechanism For Sorted Articles".

FIGS. 22 and 24 also show that the carrier tubes 24 are guided along the helical track, each with its position established by an engagement between the limb 148 of its position arm 142, and the pin 150 which it carries. The positioning arms 142 move along a path which is laterally bounded by the lower ends 216 of tip arms 216. The upper end of each tip arm 216 is attached to a rotary solenoid 218 which is mounted by a mounting bracket 220 onto a portion of a track section 192. Electrical energy delivered to a solenoid 218 causes the solenoid 218 to swing the tip arm 216 towards any position arm 142 that may be in its path of travel. When a particular article 10 is identified and then loaded into a carrier tube 24, the identification information, together with stored information in computer "B", tells the computer how many steps or positions away the just-loaded carrier tube 24 is from the particular receptacle which is to receive the article 10 that is in such tube 24. The computer "B" keeps track of the number of steps of movement of the carrier tube 24. When such carrier tube 24 reaches a position adjacent the receiving receptacle 30 for the article which it is carrying, computer "B" functions to deliver electrical energy to the solenoid 218 that is associated with the receptacle, to energize the solenoid and cause it to rotate its tip arm 216. The tip arm is rotated against the positioning arm 142 of the tube 24 and swings arm 142 away from the drum 188. This movement of the arm 142 moves the limb 148 out from under the pin 150. The disengagement of these elements removes the support for the tube 24. In response, the tube 24 drops into a position in which its open end 102 is low enough to cause the article 10 to gravitate out from the tube 24. It falls onto and is guided by a ramp 222.

The ramp 222 is formed in segments. The receptacles 30 are supported on frame members 224 which are also in segments. Track segments 192, the ramp segments 222 and the receptacle support segments 224 are all segments of separate helixes. The ramp 222 may be grooved for the purpose of guiding the articles 10 into the receptacles 30.

Figure 26:
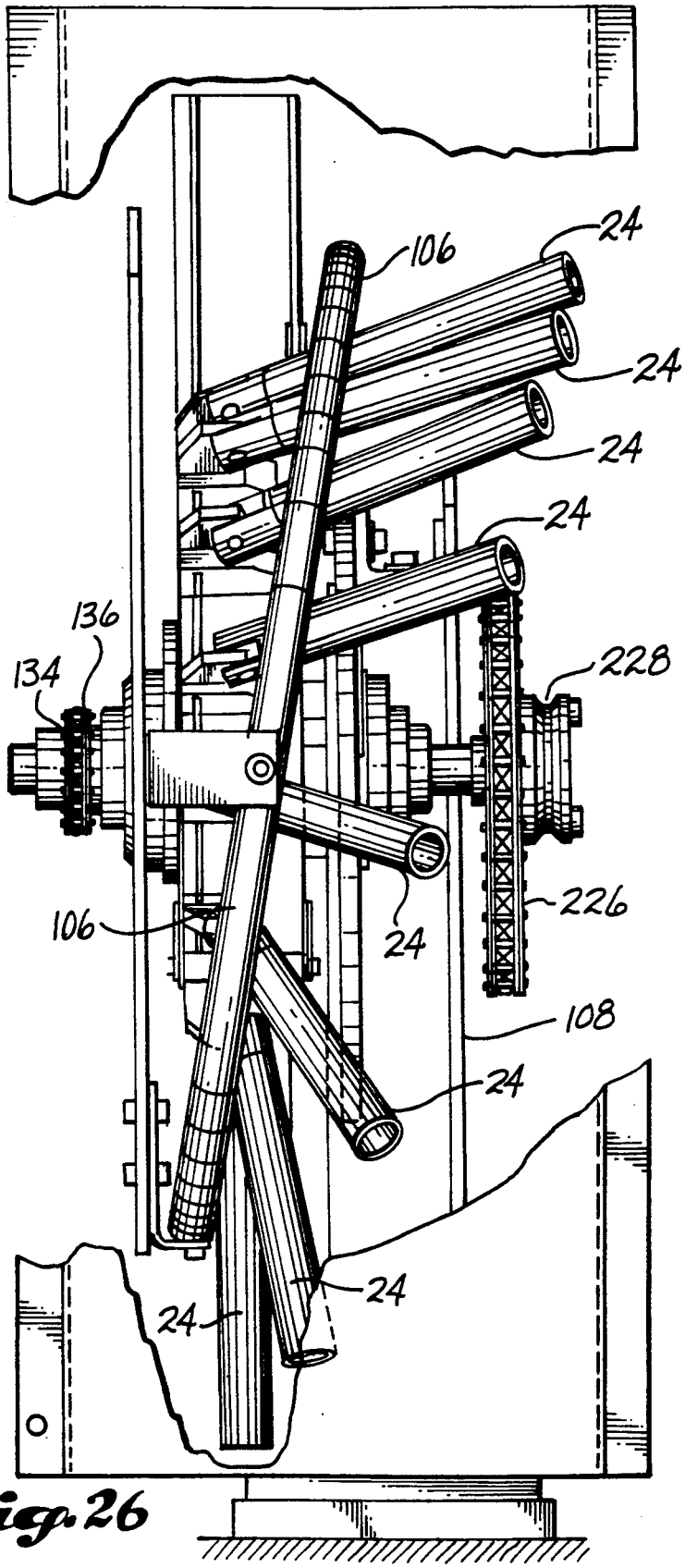
FIG. 26 is an end view taken from the aspect of line 26—26 in FIG. 25.
Figure 27:
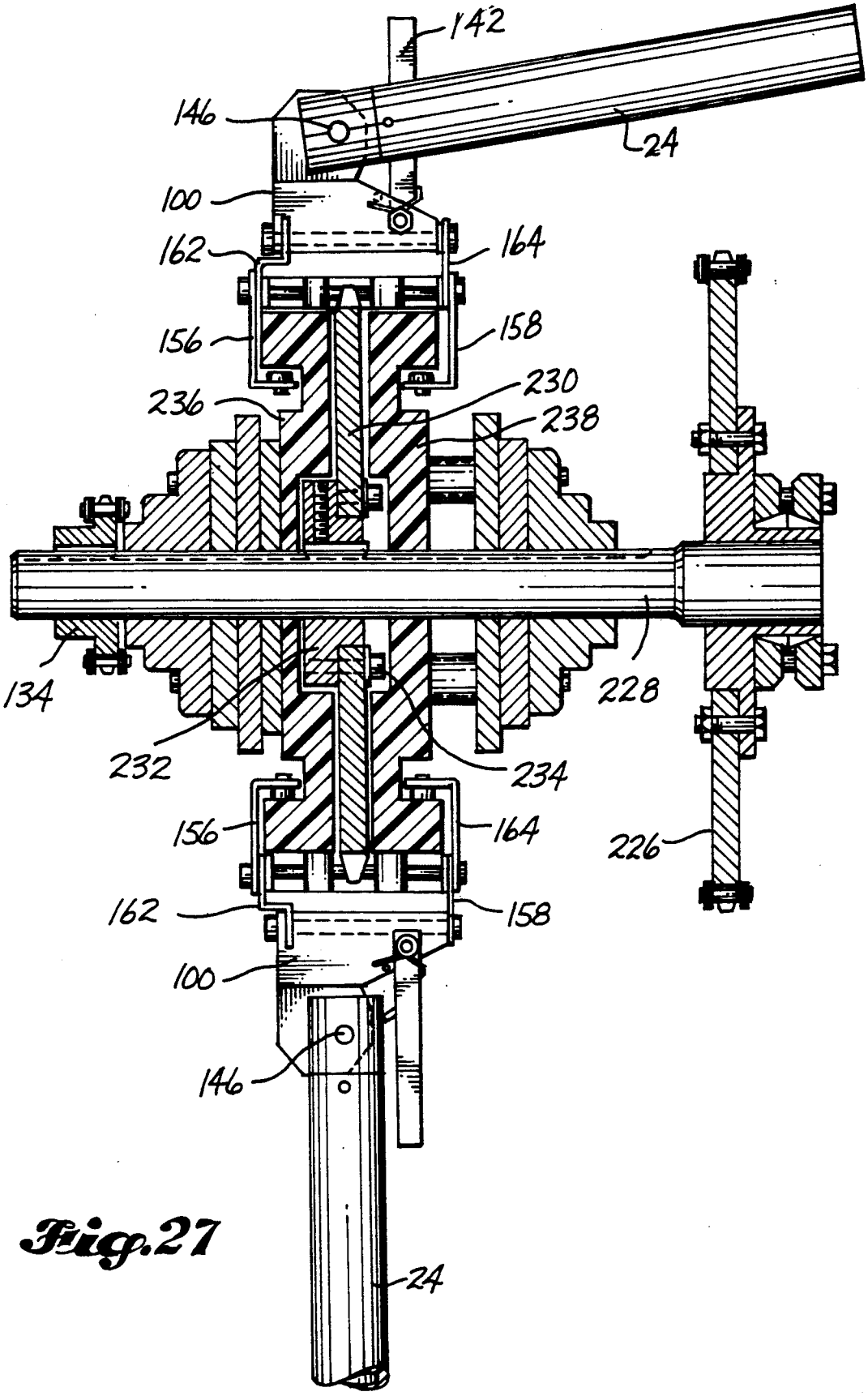
FIG. 27 is a sectional view taken substantially along line 27—27 of FIG. 25.

Referring to FIGS. 25–27, the timing chain 212 (FIG. 19) extends about and drives a sprocket 226. Sprocket 226 is connected to a shaft 228 which carries a sprocket gear 230 (FIG. 27). As shown in FIG. 27, the sprocket gear 230 includes a hub 232 which is keyed or otherwise secured to the shaft 228. The gear 230 is detachably connected to the hub 232, such as by the use of bolts 234, as illustrated. The sprocket 230 is positioned between two halves 236,238 of a fixed bearing over which the conveyor chain travels as it carries the tubes 24 from the lower run to the upper run of the conveyor at the loading station end of the mechanism. As shown by FIG. 27, the peripheral shape of the bearing 236,238 matches the peripheral shape of the track sections. As clearly shown by FIG. 26, the guide bar 106 tips the carrier tubes 24 in position as they are moved upwardly from the lower run to the upper run such that they are properly oriented for the loading operation when they arrive at the loading station.

Computer "B", which controls the delivery of the sorted articles to the receptacles 30, and the movement of such articles from the carrier tubes 24 into the receptacle 30, also keeps track of the number of articles delivered to each receptacle. Preferably, the system includes a signal function for alerting the operator when a given receptacle 30 is close to being filled and will in the near future have to be emptied. By way of typical and therefore nonlimited example, a signal light can be positioned adjacent each receptacle and controlled to be turned on when a receptacle has received a predetermined quantity of articles. Preferably also, and as schematically shown in FIG. 1, each receptacle 30 sets on a weight sensor SW which senses how full the receptacle 30 is by the weight of its contents. If for some reason a receptacle 30 is not emptied when it should be, and additional articles are delivered to it, the weight sensor will activate and shut down the system before an overfill condition occurs.

It is to be understood that the system that has been illustrated and described is presented for purposes of example only. The scope of the invention is not to be limited by the details which are illustrated and described, but only by the claims which follow, properly interpreted in accordance with established principles of patent claim interpretation, including use of the doctrine of equivalents.

What is claimed is:

1. An article sorting system, comprising:

an endless conveyor including a series of article carriers connected together and movable in succession along an endless path, from and to an article loading station, including along a path bordering a series of article receiving stations each of which is associated with a particular species of article amongst the articles to be sorted, and a conveyor drive connected to move the article carriers along the path in steps, from each article receiving station to the next;

a gravity conveyor for delivering articles to be sorted, one at a time, each to a separate article carrier while such article carrier is stopped at the article loading station;

article identification means positioned adjacent the gravity conveyor, including means for identifying the article as to species and generating an identification signal, as the article travels along the gravity conveyor past the article identification means to its article carrier; and means responsive to said identification signal and movement of the article carrier and article therein, from the article loading station into a stopped position adjacent the associated article receiving station, for moving the article out from its article carrier into the associated article receiving station;

wherein the gravity conveyor includes a lead gate and actuator means for moving the lead gate between a stop position in which it is in the path of travel of an article on the gravity conveyor and a retracted position in which it is retracted away from the path of travel an amount sufficient to allow the article to slide along the gravity conveyor, past the lead gate, and drive means for moving the lead gate will move with the lead gate at the controlled rate of travel past the article identification means, and means for operating the actuator means to retract the lead gate following movement of the article past the article identification means to enable the article to continue sliding along the gravity conveyor.

2. An article sorting system according to claim 1, wherein the means for moving the lead gate includes an elongated lead screw, a carriage including threads mating with the lead screw, and a motor for rotating the lead screw, with lead screw rotation in one direction causing the carrier to move downwardly along the lead screw and the gravity conveyor, and with reverse rotation of the lead screw causing the carrier to move upwardly along the lead screw and the gravity conveyor, and means mounting the lead gate and its actuator means on said carriage.

3. An article sorting system according to claim 1, wherein the article identification means includes means for determining the presence or absence of a particular material in each article and using this information in the generation of the identification signal.

4. An article sorting system according to claim 1, wherein the means for identifying includes scanner means positioned to provide a scanner beam through which each article must pass as it travels, and means responsive to scanner beam interruption by the article moving through the scanner beam for identifying the article as to species and generating the identification signal.

5. An article sorting system according to claim 1, wherein the articles to be sorted are drill bits and the means for identifying includes scanner means positioned to provide a scanner beam through which each drill bit must pass as it travels, and means responsive to scanner beam interruption by a drill bit moving through the scanner beam for identifying the drill bit at least as to diameter and generating the identification signal.

6. An article sorting system according to claim 5, wherein the means responsive to scanner beam interruption by a drill bit moving through the scanner beam also identifies each drill bit as to a length dimension.

7. An article sorting system according to claim 1, comprising measuring means associated with each article receiving station, for generating a control signal based on the quantity of articles at said article receiving station.

8. An article sorting system, comprising:

an endless conveyor including a series of article carriers connected together and movable in succession along an endless path, from and to an article loading station, including along a path bordering a series of article receiving stations each of which is associated with a particular species of article amongst the articles to be sorted, and a conveyor drive connected to move the article carriers along the path in steps, from each article receiving station to the next;

a gravity conveyor for delivering articles to be sorted, one at a time, each to a separate article carrier while such article carrier is stopped at the article loading station;

article identification means positioned adjacent the gravity conveyor, including means for identifying the article as to species and generating an identification signal, as the article travels along the gravity conveyor past the article identification means to its article carrier; and means responsive to said identification signal and movement of the article carrier and article therein, from the article loading station into a stopped position adjacent the associated article receiving station, for moving the article out from its article carrier into the associated article receiving station;

wherein each article carrier includes a receptacle having an open article receiving end, and releasable means for holding the receptacle in a position with its article receiving end directed upwardly by at least an amount sufficient to prevent the article from falling out of the receptacle, and pivot means connecting the receptacle to the endless conveyor and upon release of the releasable means permitting a tipping of the receptacle an amount sufficient to cause the article to move by gravity out from the receptacle, and wherein said means for moving the article out from the carrier includes said releasable means and operator means for releasing said releasable means.

9. An article sorting system according to claim 8, wherein said endless conveyor includes guide means for guiding the receptacles to and past the article loading station, said guide means including a depressible portion in general alignment with the article loading station which initially positions each receptacle, as it arrives at the article loading station, in a position with its open article receiving end elevated above the gravity conveyor, said system further including depress means responsive to a receptacle at the article loading station being ready to receive an article, to push upon the receptacle and move it downwardly until its open article receiving end is in alignment with the gravity conveyor, said depressible portion of the guide means being movable downwardly in response to the downward movement of the receptacle, and said guide means including means for moving the depressible portion upwardly against the receptacle in response to a retraction of the depress means, so that the depressible portion will move the receptacle upwardly until its open article receiving end is again above the gravity conveyor.

10. An article sorting system, comprising:

an endless conveyor including a series of article carriers connected together and movable in succession along an endless path, from and to an article loading station, including along a path bordering a series of article receiving stations each of which is associated with a particular species of article amongst the articles to be sorted, and a conveyor drive connected to move the article carriers along the path in steps, from each article receiving station to the next;

a gravity conveyor for delivering articles to be sorted, one at a time, each to a separate article carrier while such article carrier is stopped at the article loading station;

article identification means positioned adjacent the gravity conveyor, including means for identifying the article as to species and generating an identification signal, as the article travels along the gravity conveyor past the article identification means to its article carrier; and means responsive to said identification signal and movement of the article carrier and article therein, from the article loading station into a stopped position adjacent the associated article receiving station for moving the article out from its article carrier into the associated article receiving station;

wherein the means for identifying includes scanner means positioned to provide a scanner beam through which each article must pass as it travels, and means responsive to scanner beam interruption by the article moving through the scanner beam for identifying the article as to species and generating the identification signal.

11. An article sorting system, comprising:

an endless conveyor including a series of article carriers connected together and movable in succession along an endless path, from and to an article loading station, including along a path bordering a series of article receiving stations each of which is associated with a particular species of article amongst the articles to be sorted, and a conveyor drive connected to move the article carriers along the path in steps, from each article receiving station to the next;

a gravity conveyor for delivering articles to be sorted, one at a time, each to a separate article carrier while such article carrier is stopped at the article loading station;

article identification means positioned adjacent the gravity conveyor, including means for identifying the article as to species and generating an identification signal, as the article travels along the gravity conveyor past the article identification means to its article carrier; and means responsive to said identification signal and movement of the article carrier and article therein, from the article loading station into a stopped position adjacent the associated article receiving station for moving the article out from its article carrier into the associated article receiving station;

wherein the articles to be sorted are drill bits and the means for identifying includes scanner means positioned to provide a scanner beam through which each drill bit must pass as it travels, and means responsive to scanner beam interruption by a drill bit moving through the scanner beam for identifying the drill bit at least as to diameter and generating the identification signal.

12. An article sorting system according to claim 11, wherein the means responsive to scanner beam interruption by a drill bit moving through the scanner beam also identifies each drill bit as to a length dimension.

13. An article sorting system according to claim 12, wherein the length dimension is an overall length dimension.

14. An article sorting system comprising:

an endless conveyor including a series of article carriers connected together and movable in succession along an endless path, from and to an article loading station, including along a path bordering a series of article receiving stations each of which is associated with a particular species of article amongst the articles to be sorted, and a conveyor drive connected to move the article carriers along the path in steps, from each article receiving station to the next;

a gravity conveyor for delivering articles to be sorted, one at a time, each to a separate article carrier while such article carrier is stopped at the article loading station;

article identification means positioned adjacent the gravity conveyor, including means for identifying the article as to species and generating an identification signal, as the article travels along the gravity conveyor past the article identification means to its article carrier; and means responsive to said identification signal and movement of the article carrier and article therein, from the article loading station into a stopped position adjacent the associated article receiving station for moving the article out from its article carrier into the associated article receiving station;

wherein the articles to be sorted are drill bits and the means for identifying includes scanner means positioned to provide a scanner beam through which each drill bit must pass as it travels, and means responsive to scanner beam interruption by a drill bit moving through the scanner beam for identifying the drill bit as to overall length.

15. An article sorting system, comprising:

an endless conveyor including a series of article carriers connected together and movable in succession along an endless path, from and to an article loading station, including along a path bordering a series of article receiving stations each of which is associated with a particular species of article amongst the articles to be sorted, and a conveyor drive connected to move the article carriers along the path in steps, from each article receiving station to the next;

a gravity conveyor for delivering articles to be sorted, one at a time, each to a separate article carrier while such article carrier is stopped at the article loading station;

article identification means positioned adjacent the gravity conveyor, including means for identifying the article as to species and generating an identification signal, as the article travels along the gravity conveyor past the article identification means to its article carrier; and means responsive to said identification signal and movement of the article carrier and article therein, from the article loading station into a stopped position adjacent the associated article receiving station for moving the article out from its article carrier into the associated article receiving station;

wherein each receptacle is an elongated tube having a closed end and an opposite open end directed generally toward the gravity conveyor, and wherein each article carrier comprises a base member on which the closed end of its tube is pivotally mounted, for up and down pivotal movement in a direction transverse to the endless path, and guide means for guiding the tubes to and past the article loading station, said guide means including a depressible portion in general alignment with the article loading station which initially positions each tube, as it arrives at the article loading station, in a position with its open article receiving end elevated above the gravity conveyor, said system further including depress means positioned to push down upon the tube, and move it downwardly until its open article receiving end is in alignment with the gravity conveyor, said depressible portion of the guide means being movable downwardly in response to the downward movement of the tube.

16. An article sorting system according to claim 15, wherein the guide means includes means for moving the depressible portion upwardly against the tube in response to a retraction of the depress means, so that the depressible portion will move the tube upwardly until its open article receiving end is again above the gravity conveyor.

17. An article sorting system according to claim 15, wherein each article carrier includes a positioning arm which extends upwardly from said base and engages a portion of the tube and when so engaged holds the tube in a position with its open end elevated, to prevent gravity removal of an article from the tube, and operator means at each article receiving station, for disengaging the positioning arm from the tube, said tube being pivotally mounted on its base so that upon such disengagement the tube will tip over towards the article receiving station an amount sufficient to allow gravitation of the contents of the tube out from the tube and into the article receiving station.

18. An article sorting system, comprising:

an endless conveyor including a series of article carriers connected together and movable in succession along an endless path, from and to an article loading station, including along a path bordering a series of article receiving stations each of which is associated with a particular species of article amongst the articles to be sorted, and a conveyor drive connected to move the article carriers along the path in steps, from each article receiving station to the next;

a gravity conveyor for delivering articles to be sorted, one at a time, each to a separate article carrier while such article carrier is stopped at the article loading station;

article identification means positioned adjacent the gravity conveyor, including means for identifying the article as to species and generating an identification signal, as the article travels along the gravity conveyor past the article identification means to its article carrier; and means responsive to said identification signal and movement of the article carrier and article therein, from the article loading station into a stopped position adjacent the associated article receiving station for moving the article out from its article carrier into the associated article receiving station;

wherein the means responsive to said identification signal and movement of the article carrier and article therein, from the article loading station into a position adjacent the associated article receiving station, is a computer and a program which when a given identified article is delivered into a given article carrier will determine the number of steps that said particular article carrier is away from the particular article receiving station which is to receive the particular article that is in the particular carrier, and then in response to movement of the particular carrier such number of steps will move the particular article out from said particular article carrier into the associated article receiving station.

19. An article sorting system, comprising:

an endless conveyor including a series of article carriers connected together and movable in succession along an endless path, from and to an article loading station, including along a path bordering a series of article receiving stations each of which is associated with a particular species of article amongst the articles to be sorted, and a conveyor drive connected to move the article carriers along the path in steps, from each article receiving station to the next;

a gravity conveyor for delivering articles to be sorted, one at a time, each to a separate article carrier while such article carrier is stopped at the article loading station;

article identification means positioned adjacent the gravity conveyor, including means for identifying the article as to species and generating an identification signal, as the article travels along the gravity conveyor past the article identification means to its article carrier; and means responsive to said identification signal and movement of the article carrier and article therein, from the article loading station into a stopped position adjacent the associated article receiving station for moving the article out from its article carrier into the associated article receiving station;

wherein the means responsive to said identification signal and movement of the article carrier and article therein, from the article loading station into a stopped position adjacent the associated article receiving station, is a computer and a program which when a given identified article is delivered into a given article carrier will determine the number of steps that said particular article carrier is away from the particular article receiving station which is to receive the particular article that is in the particular carrier, and ten in response to movement of the particular carrier such number of steps will move the particular article out from said particular article carrier into the associated article receiving station; and wherein each article carrier includes a receptacle having an open article receiving end, and releasable means for holding the receptacle in position with its article receiving end directed upwardly by at least an amount sufficient to prevent the article from falling out of the receptacle, and pivot means connecting the receptacle to the endless conveyor and upon release of the releasable means permitting a tipping of the receptacle an amount sufficient to cause the article to move by gravity out from the receptacle, and wherein said means for moving the article out from the carrier further includes said releasable means and operator means for releasing said releasable means, controlled by said computer program.

20. An article sorting system, comprising:

an endless conveyor including a series of article carriers connected together and movable in succession along an endless path, from and to an article loading station, including along a path bordering a series of article receiving stations each of which is associated with a particular species of article amongst the articles to be sorted, and a conveyor drive connected to move the article carriers along the path in steps, from each article receiving station to the next;

a gravity conveyor for delivering articles to be sorted, one at a time, each to a separate article carrier while such article carrier is stopped at the article loading station;

article identification means positioned adjacent the gravity conveyor, including means for identifying the article as to species and generating an identification signal, as the article travels along the gravity conveyor past the article identification means to its article carrier; and means responsive to said identification signal and movement of the article carrier and article therein, from the article loading station into a stopped position adjacent the associated article receiving station for moving the article out from its article carrier into the associated article receiving station;

wherein the endless path of the endless conveyor is helical in form and wherein the article receiving stations are arranged in a helical pattern bordering the helical path.

21. An article sorting system, comprising:

an endless conveyor including a series of article carriers connected together and movable in succession along an endless path, from and to an article loading station, including along a path bordering a series of article receiving stations each of which is associated with a particular species of article amongst the articles to be sorted, and a conveyor drive connected to move the article carriers along the path in steps, from each article receiving station to the next;

a gravity conveyor for delivering articles to be sorted, one at a time, each to a separate article carrier while such article carrier is stopped at the article loading station;

article identification means positioned adjacent the gravity conveyor, including means for identifying the article as to species and generating an identification signal, as the article travels along the gravity conveyor past the article identification means to its article carrier; and means responsive to said identification signal and movement of the article carrier and article therein, from the article loading station into a stopped position adjacent the associated article receiving station for moving the article out from its article carrier into the associated article receiving station;

wherein the endless path of the endless conveyor is helical in form; and wherein each article carrier includes a receptacle having an open article receiving end, and releasable means for holding the receptacle in a position with its article receiving end directed upwardly by at least an amount sufficient to prevent the article from falling out of the receptacle, and pivot means connecting the receptacle to the endless conveyor and upon release of the releasable means permitting a tipping of the receptacle, in a direction laterally of the helical path, an amount sufficient to cause the article to move by gravity out from the receptacle, wherein said means for moving the article out from the carrier includes releasable means and operator means for releasing said releasable means, and wherein the article receiving stations are positioned laterally outwardly of the helical path of travel of the endless conveyor.

22. An article sorting system according to claim 21, wherein a guiding apron is provided for each article receiving station, laterally outwardly of the helical path of the conveyor, and between the conveyor path and the article receiving station, and wherein an article released from the receptacle will be guided by its apron into its article receiving station.

23. An article sorting system, comprising:

an endless conveyor including a series of article carriers connected together and movable in succession along an endless path, from and to an article loading station, including along a path bordering a series of article receiving stations each of which is associated with a particular species of article amongst the articles to be sorted, and a conveyor drive connected to move the article carriers along the path in steps, from each article receiving station to the next;

a gravity conveyor for delivering articles to be sorted, one at a time, each to a separate article carrier while such article carrier is stopped at the article loading station;

article identification means positioned adjacent the gravity conveyor, including means for identifying the article as to species and generating an identification signal, as the article travels along the gravity conveyor past the article identification means to its article carrier; and means responsive to said identification signal and movement of the article carrier and article therein, from the article loading station into a stopped position adjacent the associated article receiving station for moving the article out from its article carrier into the associated article receiving station; and measuring means associated with each article receiving station, for generating a control signal based on the quantity of articles at said article receiving station.

24. An article identification system, comprising:

a gravity conveyor for delivering articles to be identified, one at a time, to an article identification station;

an article identification means positioned adjacent the gravity conveyor, to form an article identification station, including means for determining one or more characteristics of the article, and generating an identification signal, as the article travels along the gravity conveyor past the article identification means; and wherein the gravity conveyor includes a lead gate and actuator means for moving the lead gate between a stop position in which it is in the path of travel of an article on the gravity conveyor and a retracted position in which it is retracted away from the path of travel an amount sufficient to allow the article to slide along the gravity conveyor, past the lead gate, and drive means for moving the lead gate in position along the gravity conveyor at a controlled rate of travel and positioned so that an article against the lead gate will move with the lead gate at the controlled rate of travel past the article identification means; and means for operating the actuator means to retract the lead gate following movement of the article past the article identification means to enable the article to continue sliding down the gravity conveyor.

25. An article identification system according to claim 24, wherein the means for moving the lead gate includes an elongated lead screw, a carriage including threads mating with the lead screw, and a motor for rotating the lead screw, with lead screw rotation in one direction causing the carrier to move downwardly along the lead screw and the gravity conveyor, and with reverse rotation of the lead screw causing the carrier to move upwardly along the lead screw and the gravity conveyor, said lead gate and said actuator means being mounted on said carriage.

26. An article identification system according to claim 24, wherein the articles to be indentified are drill bits the means for identifying includes scanner means positioned to provide a scanner beam through which each drill bit must past as it travels, and means responsive to scanner beam interruption by a drill bit moving through the scanner beam for identifying the drill bit at least to one dimensional characteristic.

27. An article identification system according to claim 26, wherein said means responsive to scanner beam interruption by a drill bit provides an identification signal based on the diameter of the drill bit.

28. An article identification system according to claim 26, wherein said means responsive to the scanner beam interruption by a drill bit provides an identification signal based on diameter and overall length of the drill bit.

29. An article identification system according to claim 26, wherein said means responsive to the scanner beam interruption by a drill bit provides an identification signal based on helical angle of the drill bit.

30. An article identification system according to claim 26, wherein said means responsive to the scanner beam interruption by a drill bit provides an identification signal based on number of margins on the drill bit.

31. An article identification system according to claim 26, wherein said means responsive to the scanner beam interruption by a drill bit provides an identification signal based on a length dimension of the drill bit.

32. An article sorting system, comprising:

an endless conveyor including a series of article carriers connected together and movable in succession along an endless path, from and to an article loading station, including along a path bordering a series of article receiving stations, each of which is associated with a particular species of article amongst the articles to be sorted, and a conveyor drive connected to move the article carriers along the path in steps, from each article receiving station to the next;

a conveyor for delivering identified articles, one at a time, each to a separate article carrier while such article carrier is stopped at the article loading station; and means for moving the article out from its article carrier into the associated article receiving station, following movement of the article carrier and the article therein to a position stopped adjacent its associated article receiving station.

* * * * *

UNITED STATES PATENT AND TRADEMARK OFFICE

CERTIFICATE OF CORRECTION

PATENT NO. : 5,139,150

DATED : August 18, 1992

INVENTOR(S) : Robert L. Fuller Jr. and Paul E. Faville

It is certified that error appears in the above-identified patent and that said Letters Patent is hereby corrected as shown below:

Col. 1, line 50, "07/290,130" should be -- 07/270,130 --.

Col. 6, line 48, "gate G2" should be -- gate G3 --.

Col. 7, line 39, delete the period after "station".

Col. 7, line 56, there should be a period after "measured".

Col. 14, line 34, delete "216", first occurrence.

Claim 1, col. 16, line 17, after "the lead gate", insert:

-- in position along the gravity conveyor at a controlled rate of travel and positioned so that an article against --.

Claim 19, col. 21, line 43, "ten" should be -- then --.

Claim 23, col. 23, line 31, delete -- and --.

Claim 26, col. 24, line 18, after "bits", insert -- and --.

Signed and Sealed this

Twenty-first Day of March, 1995

*Attest:*

Bruce Lehman

BRUCE LEHMAN

*Attesting Officer*

*Commissioner of Patents and Trademarks*